US011788714B2

(12) United States Patent
Kang et al.

(10) Patent No.: US 11,788,714 B2
(45) Date of Patent: Oct. 17, 2023

(54) LIGHT EMITTING MODULE REPLACEMENT TYPE LIGHT EMITTING DEVICE

(71) Applicant: UVER CO., LTD., Ansan-si (KR)

(72) Inventors: Yong-Hoon Kang, Ansan-si (KR); Kyung-Yong Kim, Ansan-si (KR)

(73) Assignee: UVER CO., LTD., Ansan-si (KR)

( * ) Notice: Subject to any disclaimer, the term of this patent is extended or adjusted under 35 U.S.C. 154(b) by 0 days.

(21) Appl. No.: 18/074,550

(22) Filed: Dec. 5, 2022

(65) Prior Publication Data

US 2023/0213175 A1 Jul. 6, 2023

(30) Foreign Application Priority Data

Jan. 6, 2022 (KR) ..... 10-2022-0002076

(51) Int. Cl.
*F21V 19/04* (2006.01)
*F21V 29/70* (2015.01)
*F21S 2/00* (2016.01)

(52) U.S. Cl.
CPC ..... *F21V 19/04* (2013.01); *F21S 2/005* (2013.01); *F21V 29/70* (2015.01)

(58) Field of Classification Search
CPC ..... F21S 2/005; F21V 29/70; F21V 19/04
See application file for complete search history.

(56) References Cited

FOREIGN PATENT DOCUMENTS

| | | | | | |
|---|---|---|---|---|---|
| CN | 104456200 | B | * | 6/2016 | ..... F21S 2/00 |
| DE | 202016107013 | U1 | * | 1/2017 | |
| EP | 2921764 | A1 | | 9/2015 | |
| KR | 10-2013-0095928 | A | | 8/2013 | |
| KR | 10-1449516 | B1 | | 10/2014 | |
| KR | 102120358 | B1 | * | 6/2020 | |
| WO | 2011/139764 | A2 | | 11/2011 | |

* cited by examiner

*Primary Examiner* — Anabel Ton

(57) ABSTRACT

The present disclosure provides a light emitting module replacement type light emitting device including: one or more light emitting modules (100) configured to include a substrate (110), one or more light emitting diodes (120) mounted on one side surface of the substrate (110) in a third direction, and a light emitting module terminal (130) electrically connected to the one or more light emitting diodes (120); a heat sink (200) having a contact surface (S) which is configured to come in contact with the light emitting modules (100); and one or more binding clips (300) coupled to the heat sink (200), positioned on the contact surface (S) and electrically connected to an external power supply. The light emitting module terminal (130) of each of the light emitting modules (100) may be fitted between each of the binding clips (300) and the contact surface (S) of the heat sink (200), and accordingly, the light emitting module terminal (130) may come in contact with and be electrically connected to the binding clip (300), and may come in contact with the contact surface (S). Thus, with a low-cost, simple configuration, the light emitting module (100) can be easily attached to or detached from the heat sink (200), and a failed light emitting module (100) can be easily replaced.

15 Claims, 22 Drawing Sheets

LIGHT EMITTING MODULE REPLACEMENT TYPE LIGHT EMITTING DEVICE

CROSS-REFERENCE TO RELATED APPLICATION

This application claims priority to and the benefit of Korean Patent Application No. 10-2022-0002076, filed on Jan. 6, 2022, the disclosures of which is incorporated herein by reference in its entirety.

FIELD OF THE INVENTION

The present disclosure relates to a light emitting module replacement type light emitting device, and more particularly, to a light emitting module replacement type light emitting device which allows a light emitting module to be easily attached or detached and a failed light emitting module to be easily replaced with a low-cost, simple configuration.

DESCRIPTION OF RELATED ART

Light emitting devices using light emitting diodes are widely used for a lighting device, an exposure device, a curing device, and the like.

A light emitting module replacement type light emitting device is used in order to reduce waste of having to replace the entire light emitting device in a case in which some light emitting diodes are defective. The light emitting module replacement type light emitting device may be configured to include a plurality of detachable light emitting modules. Each light emitting module may include a plurality of light emitting diodes. Thus, in a case in which some light emitting diodes are defective, only the light emitting module including the defective light emitting diodes may be replaced.

In the light emitting module replacement type light emitting device, in order to replace a light emitting module, an existing light emitting module should be removed from the light emitting device, and then a new light emitting module should be attached to or installed in the light emitting device.

Here, in order to install the light emitting module in the light emitting device, i) the light emitting module should be electrically connected to a terminal inside the light emitting device; and ii) in a case in which the light emitting module itself does not include a heat sink, the light emitting module should be brought into close contact with a heat sink of the light emitting device and fixed. For example, the light emitting module should be fixed to each of the terminal and the heat sink inside the light emitting device using a bolt or the like. Consequently, it is complicated and takes a long time to attach or detach the light emitting module.

Also, during attachment or detachment of a light emitting module, the light emitting module may be damaged when light emitting diodes of the light emitting module are pressed or a connecting/coupling/bonding portion between the light emitting diodes and a substrate is pressed. Thus, attachment or detachment of the light emitting module requires special attention or training.

Therefore, there is a need for a light emitting module replacement type light emitting device which allows a light emitting module to be easily attached or detached and allows anyone to attach or detach the light emitting module without special attention or training.

The related art is as follows.

Korean Patent Publication No. 10-2013-0095928 relates to a plant cultivation apparatus having a detachable LED module, the plant cultivation apparatus including: a plurality of fixing bolts configured to pass through the LED module and be screw-coupled to a female screw portion of a support protrusion to fix the LED module to the support protrusion; and a power supply connected to the LED module to supply power to the LED module.

However, in the related art, since a plurality of bolts should be used to fix the LED module when installing the LED module, and a power cable should be connected to a connector of the LED module to connect the power, it is difficult to attach or detach the LED module. Also, since LEDs of the LED module are exposed to the outside, special attention or training is necessary for attaching or detaching the LED module.

RELATED ART DOCUMENT

Patent Document (Patent Document 001) Korean Patent Publication No. 10-2013-0095928

SUMMARY OF THE INVENTION

Embodiments of the present disclosure are directed to providing a light emitting module replacement type light emitting device which allows a light emitting module to be easily attached or detached and a failed light emitting module to be easily replaced with a low-cost, simple configuration.

Embodiments of the present disclosure are also directed to providing a light emitting module replacement type light emitting device which reduces manufacturing costs and maintenance and management costs.

Embodiments of the present disclosure are also directed to providing a light emitting module replacement type light emitting device whose cooling performance is easily improved with a low-cost, simple configuration.

Embodiments of the present disclosure are also directed to providing a light emitting module replacement type light emitting device which allows a light emitting module to be easily and correctly installed.

Embodiments of the present disclosure are also directed to providing a light emitting module replacement type light emitting device with a reduced size and weight.

Embodiments of the present disclosure are also directed to providing a light emitting module replacement type light emitting device in which a light emitting module is stably fixed, the light emitting module comes in close contact with a heat sink, and an electrically connected state of the light emitting module is stably maintained.

Embodiments of the present disclosure are also directed to providing a light emitting module replacement type light emitting device which allows anyone to easily attach or detach a light emitting module without special attention or training.

The present disclosure provides a light emitting module replacement type light emitting device (10) including: one or more light emitting modules (100), a heat sink (200) and one or more binding clips (300).

The one or more light emitting modules (100) may be configured to include a substrate (110), one or more light emitting diodes (120) and a light emitting module terminal (130).

The substrate (110) may be configured to extend in a first direction and a second direction which intersects the first direction.

The one or more light emitting diodes (120) may be mounted on one side surface of the substrate (110) in a third direction which intersects the first direction and the second direction.

The light emitting module terminal (130) may be provided on one side end of the substrate (110) in the first direction.

The light emitting module terminal (130) may be electrically connected to the one or more light emitting diodes (120).

The heat sink (200) may have a contact surface (S) provided on one end in the third direction.

The contact surface (S) may be configured to come in contact with the light emitting modules (100).

The one or more binding clips (300) may be configured to include a coupling portion (310) and a connecting portion (320).

The coupling portion (310) may be coupled to the heat sink (200).

The connecting portion (320) may be connected to the coupling portion (310).

The connecting portion (320) may be positioned on or above the contact surface (S).

The one or more binding clips (300) may be electrically connected to an external power supply.

The light emitting module terminal (130) of each of the light emitting modules (100) may be fitted between the connecting portion (320) of each of the binding clips (300) and the contact surface (S) of the heat sink (200).

Accordingly, the light emitting module terminal (130) may come in contact with and be electrically connected to the binding clip (300), and the other side surface of the light emitting module (100) in the third direction may come in contact with the contact surface (S).

In one embodiment, in the light emitting module replacement type light emitting device (10), the binding clip (300) and the light emitting module (100) may be provided as a plurality of binding clips (300) and a plurality of light emitting modules (100).

The plurality of binding clips (300) may be disposed side by side in the second direction.

The connecting portion (320) of each of the binding clips (300) may extend in the first direction or extend in a direction inclined in the third direction toward the first direction.

The light emitting module terminal (130) of each of the light emitting modules (100) may be fitted or removed in the first direction between the connecting portion (320) of each of the binding clips (300) and the contact surface (S) of the heat sink (200).

In one embodiment, in each of the light emitting modules (100), the light emitting module terminal (130) may include a first light emitting module terminal (132) and a second light emitting module terminal (134).

The first light emitting module terminal (132) may be provided on one side end in the second direction of the one side end of the substrate (110) in the first direction.

The second light emitting module terminal (134) may be provided on the other side end in the second direction of the one side end of the substrate (110) in the first direction.

Each of the binding clips (300) may include a first clip portion (300A) and a second clip portion (300B).

The first clip portion (300A) and the second clip portion (300B) may be disposed a predetermined distance apart from each other in the second direction on one side and the other side in the second direction.

The first clip portion (300A) and the second clip portion (300B) may each include the coupling portion (310) and the connecting portion (320).

The first light emitting module terminal (132) may come in contact with and be electrically connected to the first clip portion (300A).

The second light emitting module terminal (134) may come in contact with and be electrically connected to the second clip portion (300B).

In one embodiment, the binding clip (300) may be a leaf spring having elasticity.

In one embodiment, the coupling portion (310) may be disposed on or above one side surface of the heat sink (200) in the first direction and may be coupled to the one side surface of the heat sink (200) in the first direction.

The connecting portion (320) may be bent from one end of the coupling portion (310) in the third direction and extend toward the other side in the first direction or may extend in a direction inclined in the third direction toward the other side in the first direction.

In one embodiment, the light emitting module replacement type light emitting device (10) may further include a support member (400).

The support member (400) may be coupled to face the one side surface of the heat sink (200) in the first direction.

The support member (400) may extend in the third direction.

The support member (400) may protrude toward one side in the third direction past the contact surface (S).

The coupling portion (310) may be coupled to one side surface of the support member (400) in the first direction.

The coupling portion (310) may extend in the third direction along the support member (400) while in contact with the support member (400) to protrude toward the one side in the third direction past the contact surface (S).

The connecting portion (320) may be bent from the one end of the coupling portion (310) in the third direction to extend toward the other side in the first direction or extend in the direction inclined in the third direction toward the other side in the first direction.

The connecting portion (320) may include a first portion (P1) which extends at a slant at the other side in the third direction toward the other side in the first direction.

In one embodiment, the connecting portion (320) may include the first portion (P1) whose distance from the contact surface (S) in the third direction gradually decreases toward a distal end.

The connecting portion (320) may include a second portion (P2) disposed at a distal side of the connecting portion (320) past the first portion (P1) and whose distance from the contact surface (S) in the third direction gradually increases toward a distal end.

The light emitting module terminal (130) may be inserted into a space between the second portion (P2) and the contact surface (S) of the heat sink (200) to be fitted between the connecting portion (320) and the contact surface (S) and come in contact with the distal end of the first portion (P1) or a rear end of the second portion (P2).

In one embodiment, the light emitting module (100) may further include a frame (140) and a protective glass (150).

The frame (140) may be coupled to the substrate (110).

The frame (140) may be configured to surround the one or more light emitting diodes (120).

The frame (140) may protrude from the substrate (110) toward the one side in the third direction.

The protective glass (150) may be coupled to the frame (140).

The protective glass (150) may be configured to cover the one or more light emitting diodes (120).

In one embodiment, a guide groove (142) which extends in the second direction and into which the protective glass (150) is inserted may be formed in the frame (140).

The protective glass (150) may be inserted into the guide groove (142) in the second direction.

In one embodiment, the light emitting module terminal (130) may be formed of a copper foil formed on the substrate (110).

In one embodiment, the light emitting module (100) may further include an auxiliary member (160) disposed at the other side of the substrate (110) in the first direction.

The auxiliary member (160) may be directly coupled or indirectly coupled to the substrate (110).

In one embodiment, the auxiliary member (160) may further protrude toward the one side in the third direction past the substrate (110).

In one embodiment, in the auxiliary member (160), a first bolt through-hole (162) which passes through the auxiliary member (160) in the third direction may be formed.

The first bolt through-hole (162) may include a third portion (P3) whose cross-sectional area gradually decreases toward the other side in the third direction.

In the heat sink (200), a first bolt insertion groove (202) which communicates with the first bolt through-hole (162) and extends in the third direction may be formed at a position corresponding to the first bolt through-hole (162).

A cross-sectional area of the other end of the first bolt through-hole (162) in the third direction may be larger than a cross-sectional area of the first bolt insertion groove (202).

A bolt (B) may have a head portion (B1) including a shape that corresponds to the third portion (P3).

A bolt (B) may be inserted into the first bolt through-hole (162) and the first bolt insertion groove (202) toward the other side in the third direction.

In one embodiment, in each of the light emitting modules (100), the light emitting module terminal (130) may include the first light emitting module terminal (132) and the second light emitting module terminal (134) each provided on the one side end in the second direction of the one side end of the substrate (110) in the first direction and the other side end in the second direction of the one side end of the substrate (110) in the first direction.

Each of the binding clips (300) may include the first clip portion (300A) and the second clip portion (300B).

The first clip portion (300A) and the second clip portion (300B) may be disposed a predetermined distance apart from each other in the second direction on the one side and the other side in the second direction and may each include the coupling portion (310) and the connecting portion (320).

The first light emitting module terminal (132) may come in contact with and be electrically connected to the first clip portion (300A).

The second light emitting module terminal (134) may come in contact with and be electrically connected to the second clip portion (300B).

In the auxiliary member (160), the first bolt through-hole (162) which passes through the auxiliary member (160) in the third direction may be formed.

A position of the first bolt through-hole (162) in the second direction may correspond to an intermediate position between the first light emitting module terminal (132) and the second light emitting module terminal (134).

In the heat sink (200), the first bolt insertion groove (202) which communicates with the first bolt through-hole (162) and extends in the third direction may be formed at the position corresponding to the first bolt through-hole (162).

The bolt (B) may be inserted into the first bolt through-hole (162) and the first bolt insertion groove (202) toward the other side in the third direction.

In one embodiment, the light emitting module (100) may further include a heat dissipation plate (170).

The other side surface of the substrate (110) in the third direction may be directly coupled to one side in the first direction of one side surface of the heat dissipation plate (170) in the third direction.

The auxiliary member (160) may be coupled to the other side of the heat dissipation plate (170) in the first direction.

The other side surface of the heat dissipation plate (170) in the third direction may come in contact with the contact surface (S) when the light emitting module terminal (130) is fitted between the connecting portion (320) of the binding clip (300) and the contact surface (S) of the heat sink (200).

The auxiliary member (160) may be indirectly coupled to the substrate (110) through the heat dissipation plate (170).

BRIEF DESCRIPTION OF DRAWINGS

The above and other objects, features and advantages of the present disclosure will become more apparent to those of ordinary skill in the art by describing exemplary embodiments thereof in detail with reference to the accompanying drawings, in which.

DETAILED DESCRIPTION OF THE INVENTION

Figure 1:
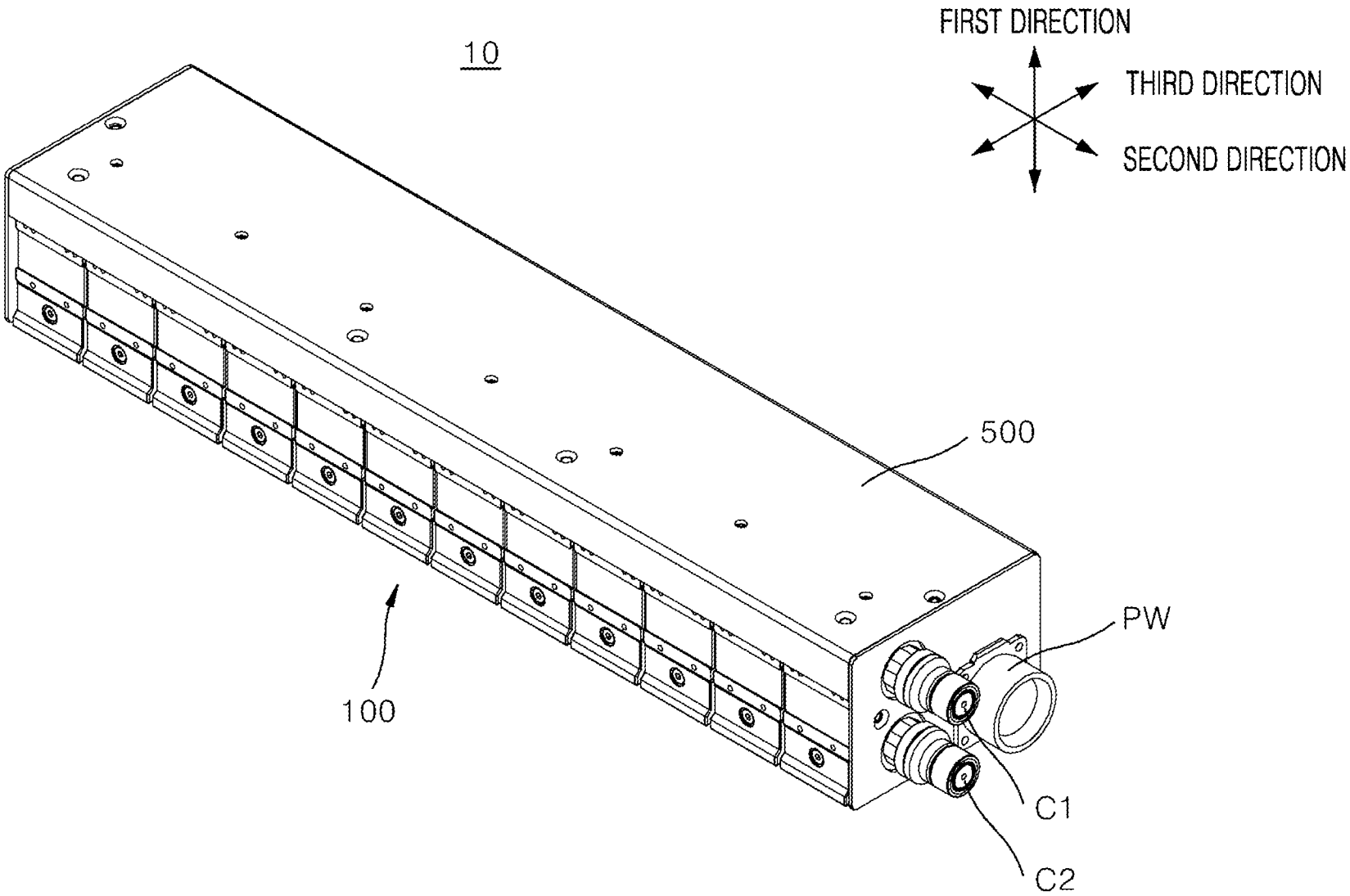
FIGS. 1 and 2 are a perspective view and a front view, respectively, of a light emitting module replacement type light emitting device according to an embodiment of the present disclosure.

Hereinafter, exemplary embodiments of the present disclosure will be described in detail with reference to the accompanying drawings.

The present disclosure is not limited to the embodiments disclosed below and may be changed in various ways and implemented in various different forms. The present embodiments make the disclosure of the present disclosure complete and are provided to completely inform those of ordinary skill in the art of the scope of the disclosure. Therefore, the present disclosure should be understood as, instead of being limited to the embodiments disclosed below, including all changes, equivalents, or substitutes included in the technical spirit and scope of the present disclosure as well as any substitution or addition made between a configuration of any one embodiment and a configuration of another embodiment.

The accompanying drawings are only provided to facilitate understanding of the embodiments disclosed herein, and the technical spirit disclosed herein is not limited by the accompanying drawings and should be understood as including all changes, equivalents, or substitutes included in the spirit and technical scope of the present disclosure. In the drawings, sizes or thicknesses of elements may be exaggerated or reduced in consideration of convenience of understanding, etc., but the scope of the present disclosure should not be construed as being limited thereby.

The terms used herein are only used to describe specific implementation examples or embodiments and are not intended to limit the present disclosure. Also, a singular expression includes a plural expression unless the context clearly indicates otherwise. In this specification, terms such as "include" or "consist of" are intended to designate that features, numbers, steps, operations, elements, parts, or combinations thereof described herein are present. That is, in this specification, the terms such as "include" or "consist of" should not be understood as precluding the possibility of presence or addition of one or more other features, numbers, steps, operations, elements, parts, or combinations thereof.

Terms including ordinals such as "first" and "second" may be used to describe various elements, but the elements are not limited by the terms. The terms are only used for the purpose of distinguishing one element from another element.

When a certain element is mentioned as being "connected" or "linked" to another element, although the certain element may be directly connected or linked to the other element, it should be understood that another element may be present therebetween. On the other hand, when a certain element is mentioned as being "directly connected" or "directly linked" to another element, it should be understood that other elements are not present therebetween.

When a certain element is mentioned as being "above" or "below" another element, it should be understood that the certain element may be disposed directly above the other element or another element may be present therebetween.

Unless otherwise defined, all terms including technical or scientific terms used herein have the same meaning as commonly understood by one of ordinary skill in the art to which the present disclosure pertains. Terms, such as those defined in commonly used dictionaries, should be construed as having a meaning that is consistent with their meaning in the context of the relevant art and are not to be construed in an idealized or overly formal sense unless expressly so defined herein.

A light emitting module replacement type light emitting device disclosed in the following embodiments will be described in more detail with reference to each drawing.

[Light Emitting Module Replacement Type Light Emitting Device]

Figure 2:
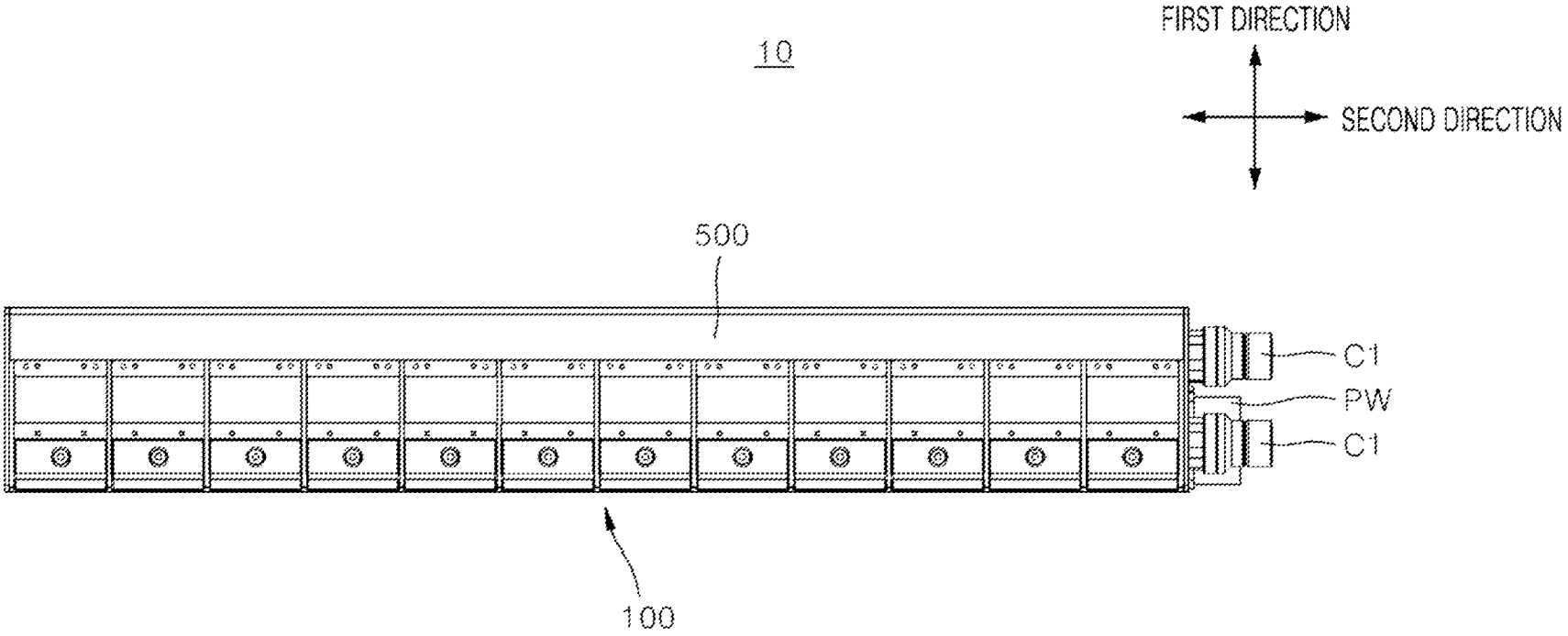
Figure 3:
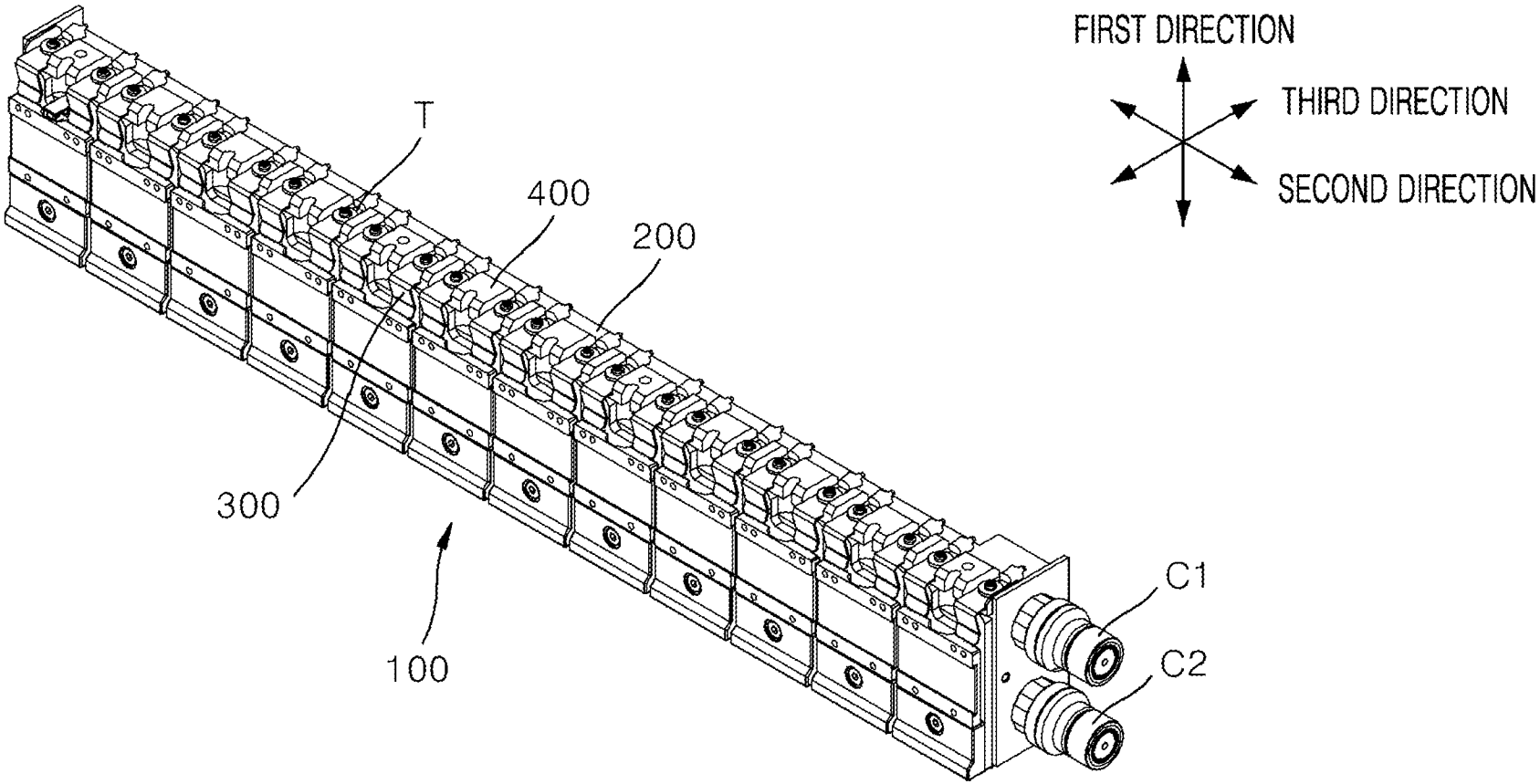
FIGS. 3 and 4 are a perspective view and a front view, respectively, of a state in which a housing and a power connector are removed from the light emitting module replacement type light emitting device of FIGS. 1 and 2.
Figure 4:
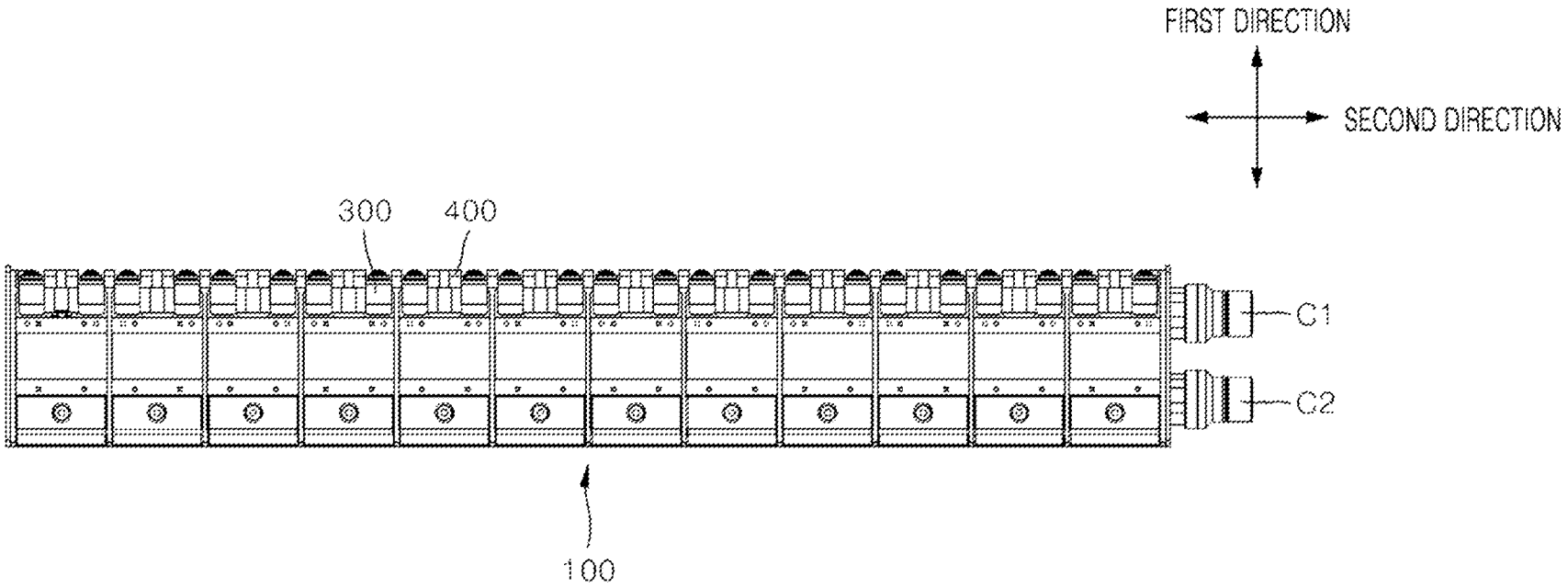
Figure 5:
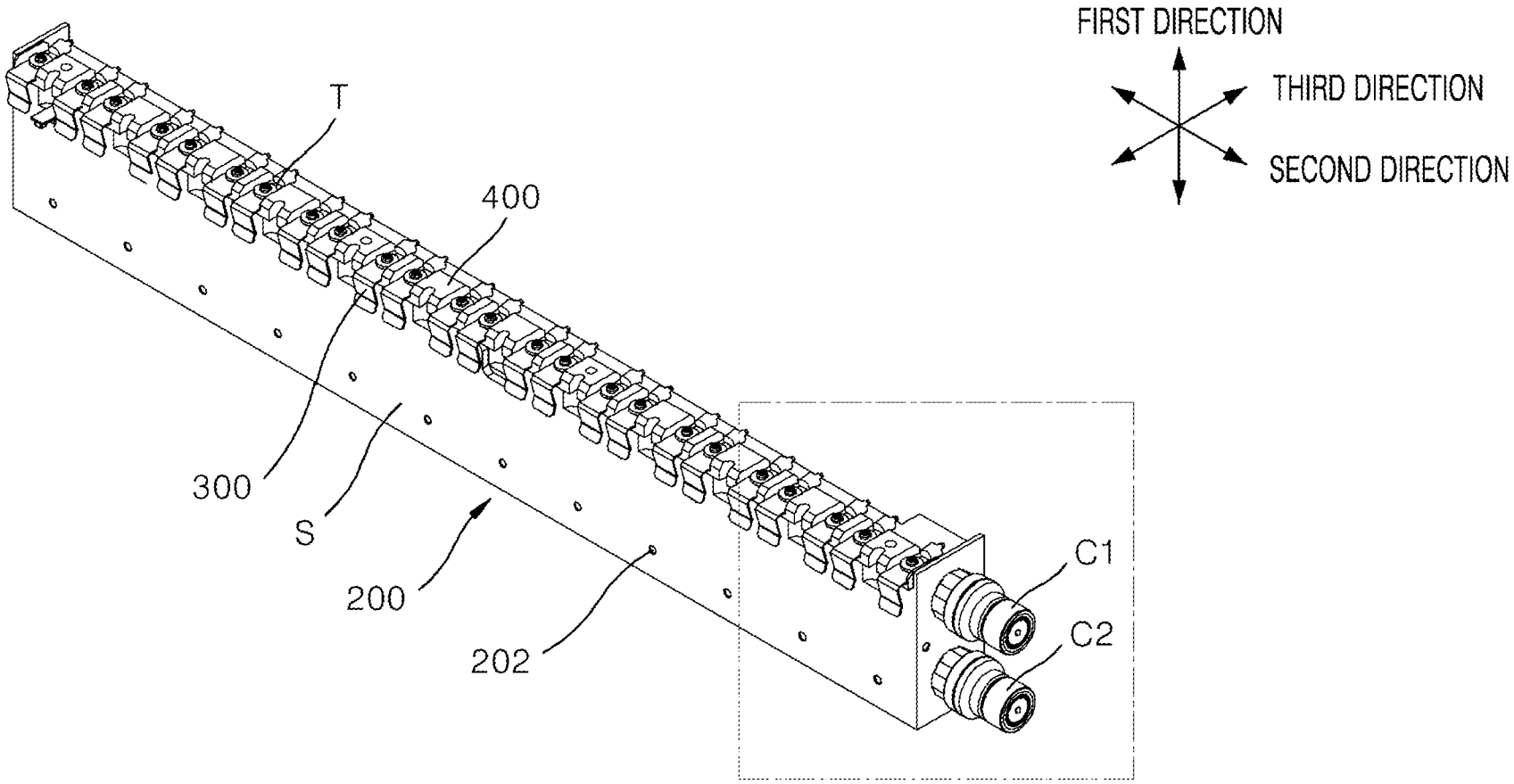
FIG. 5 is a perspective view illustrating a state in which a light emitting module according to a first embodiment is removed from the state of FIGS. 3 and 4.
Figure 6:
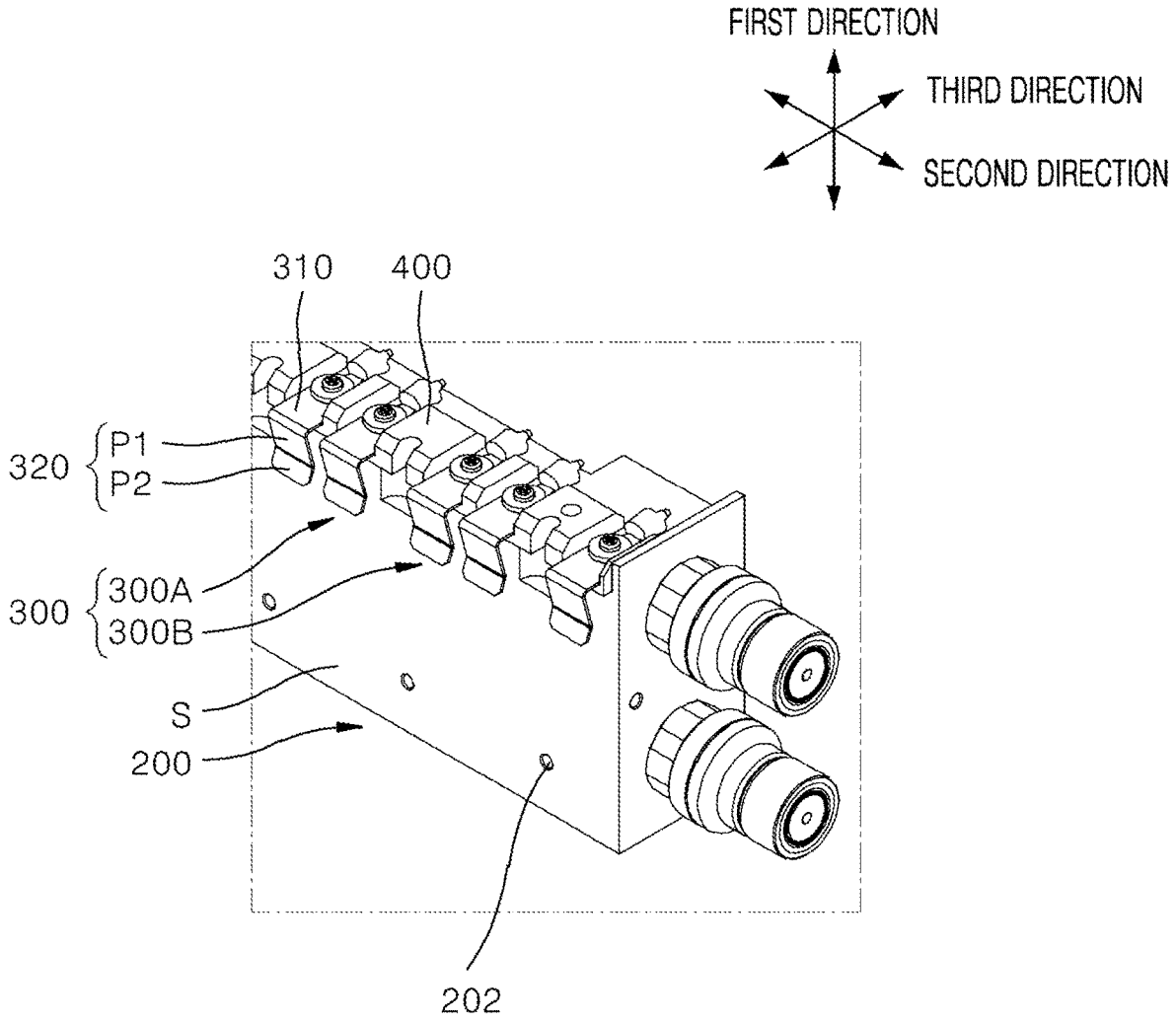
FIG. 6 is an enlarged perspective view of a portion indicated by an alternate long and short dash line in FIG. 5.
Figure 7:
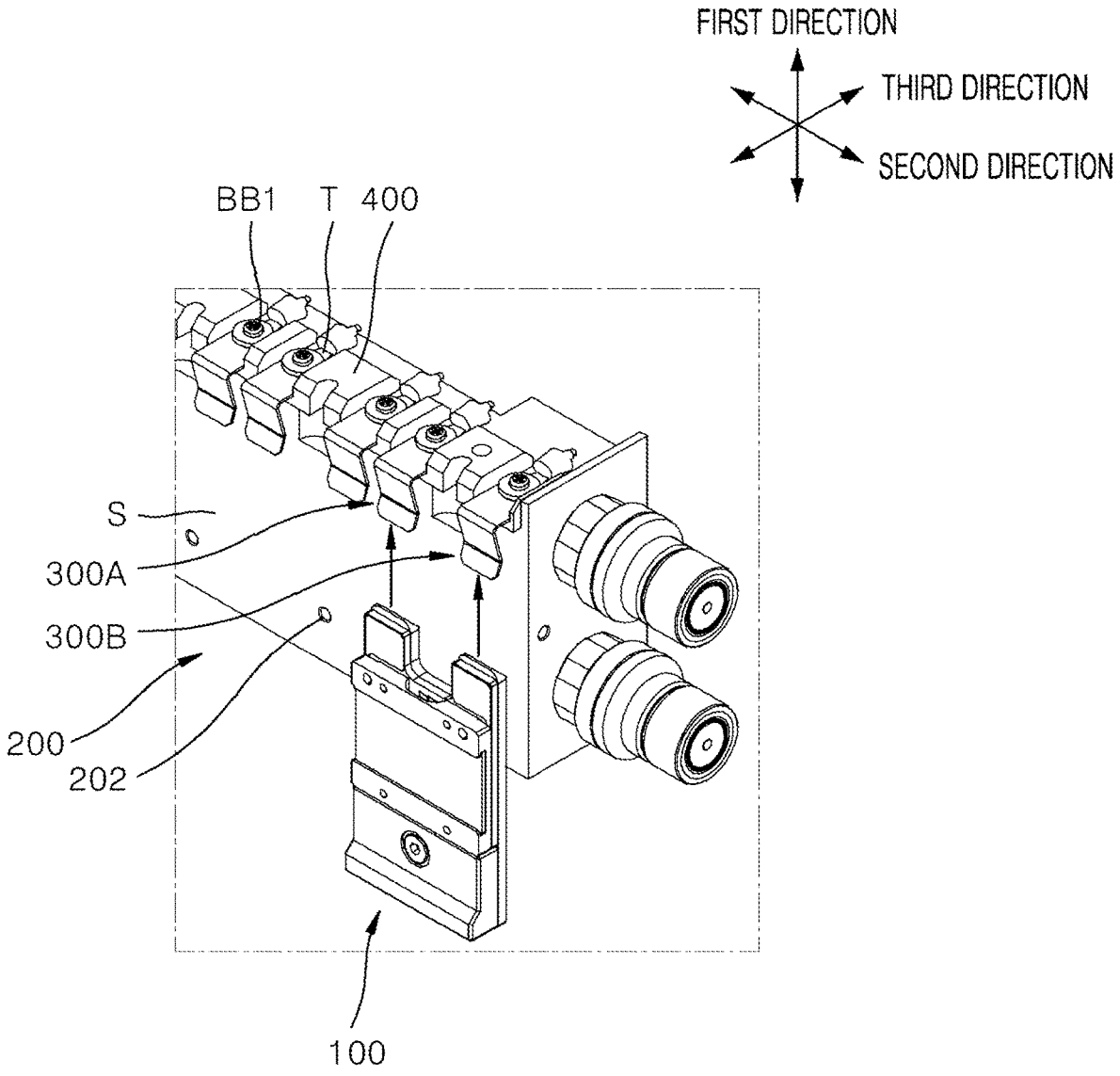
FIGS. 7 and 8 are state views illustrating a process of installing the light emitting module according to the first embodiment from the state of FIG. 6.
Figure 8:
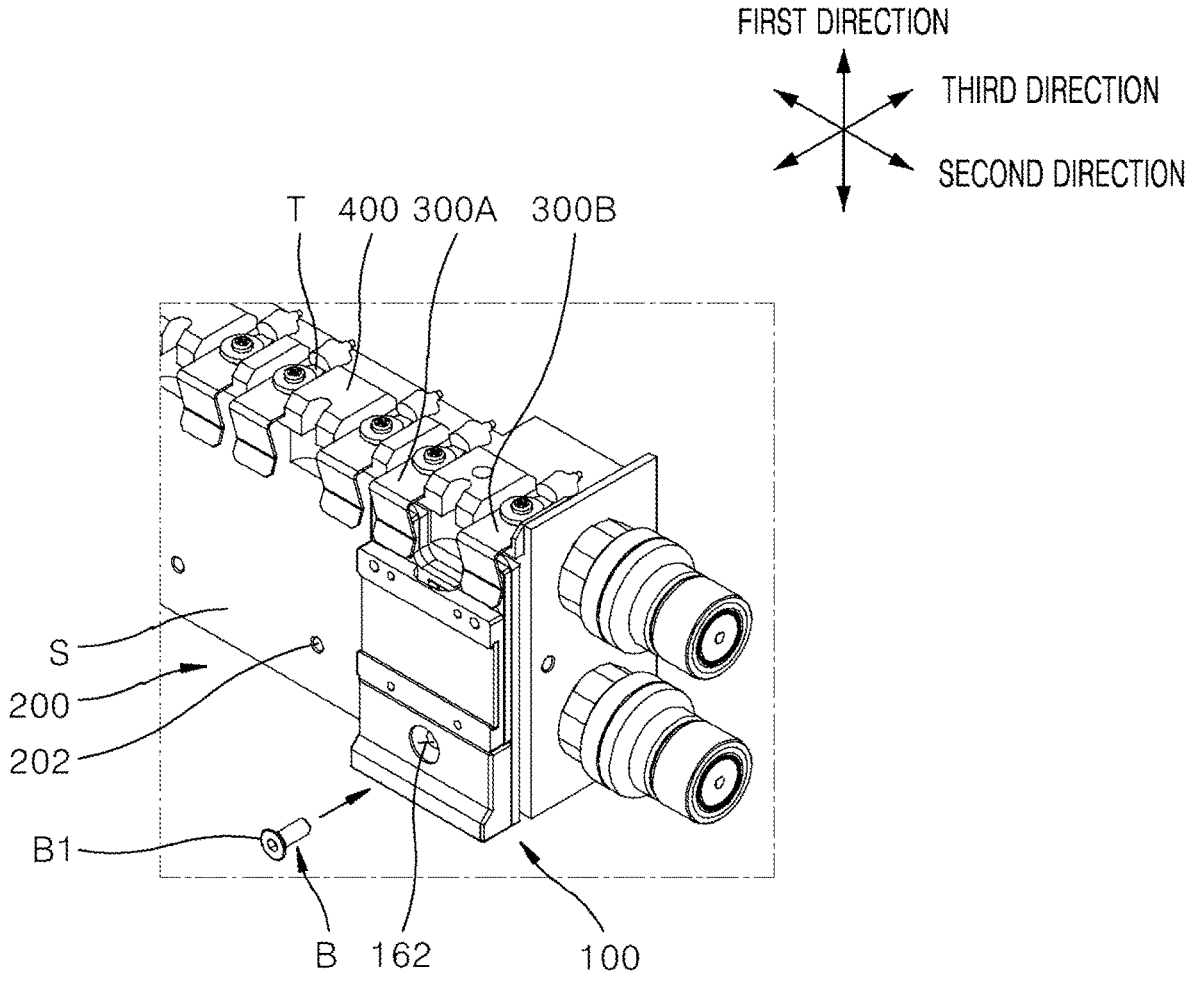
Figure 9:
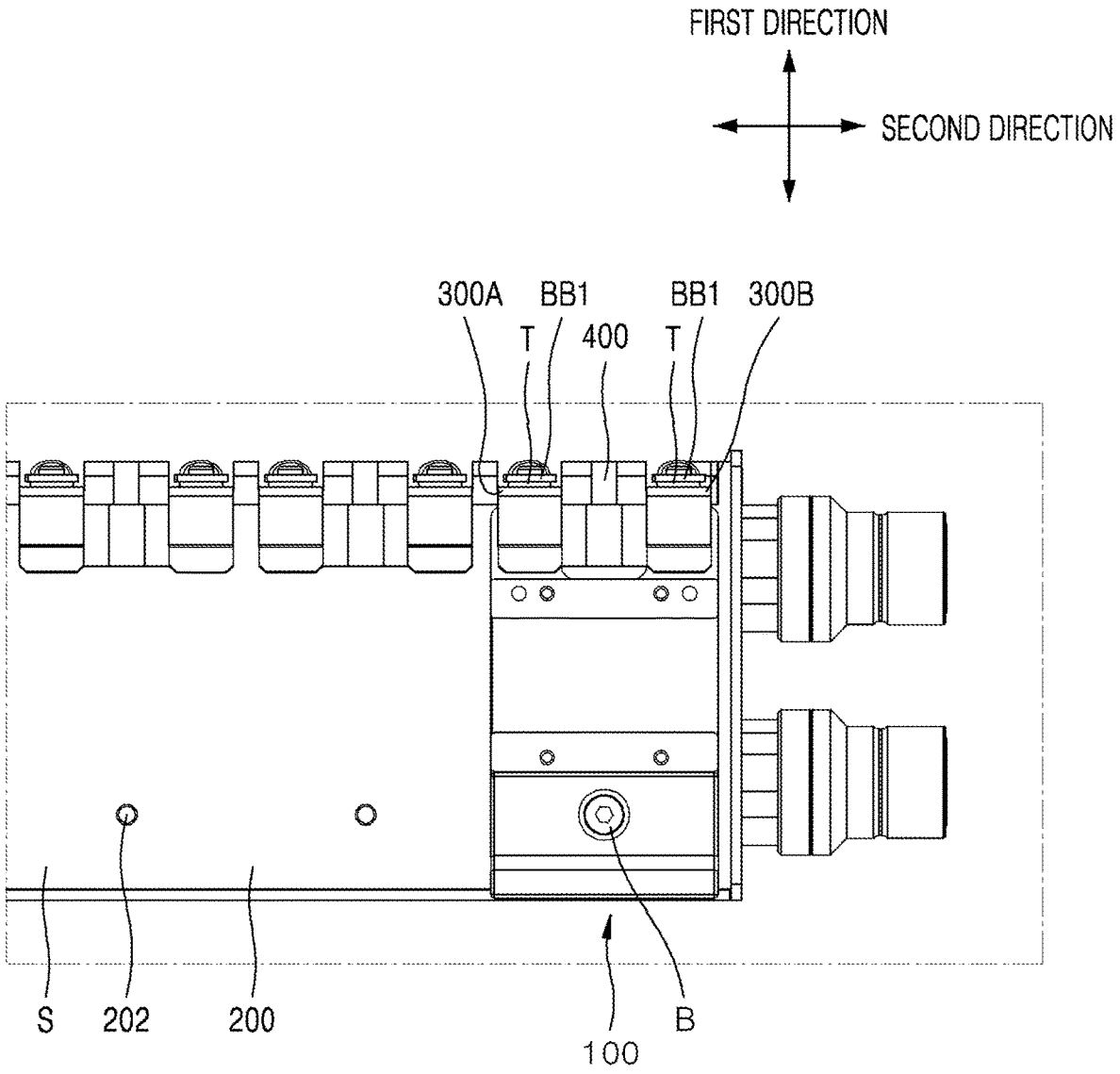
FIGS. 9 and 10 are a front view and a lateral view, respectively, of a state in which the light emitting module according to the first embodiment is installed on a heat sink from the state of FIG. 6.
Figure 10:
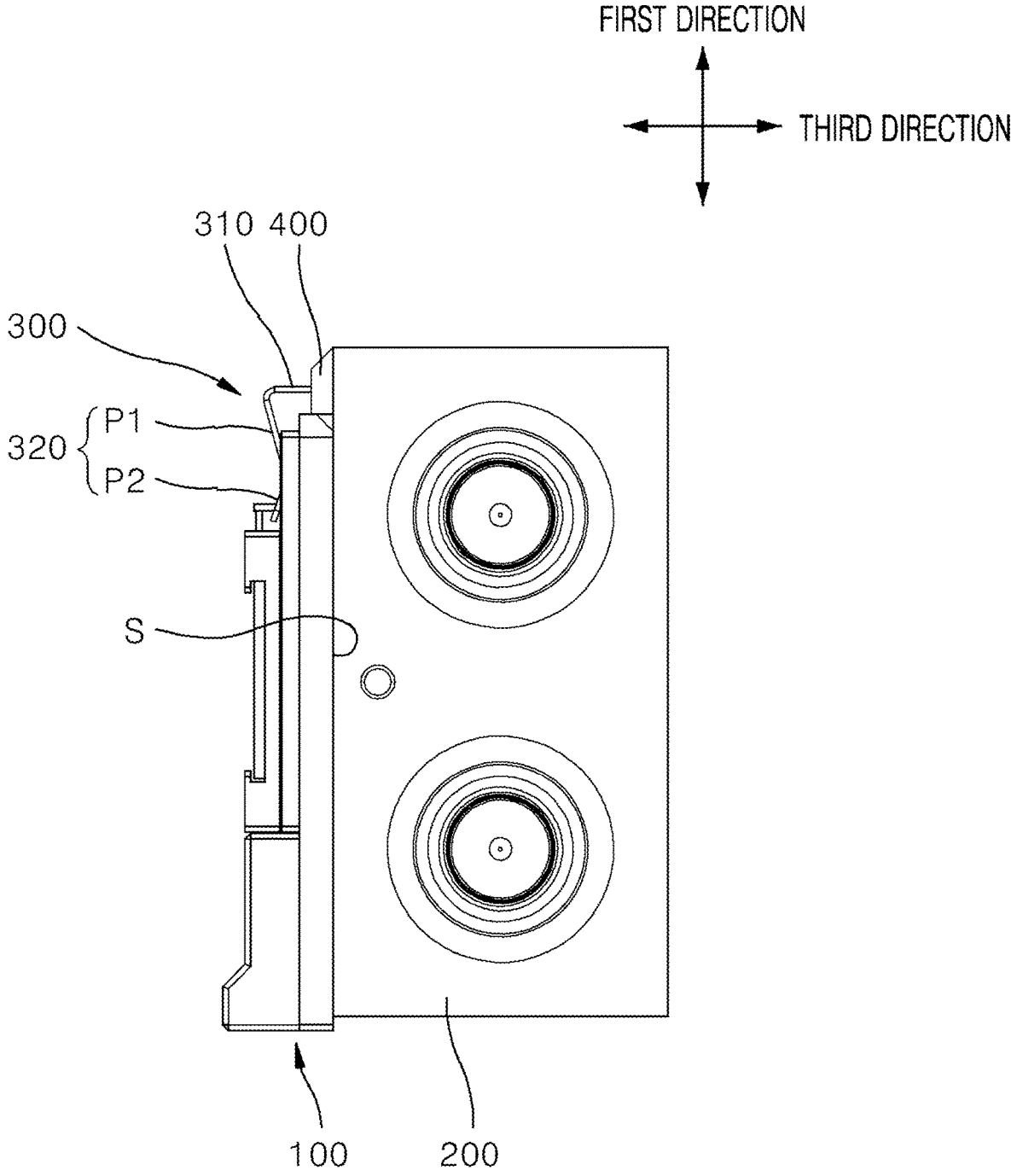
Figure 11:
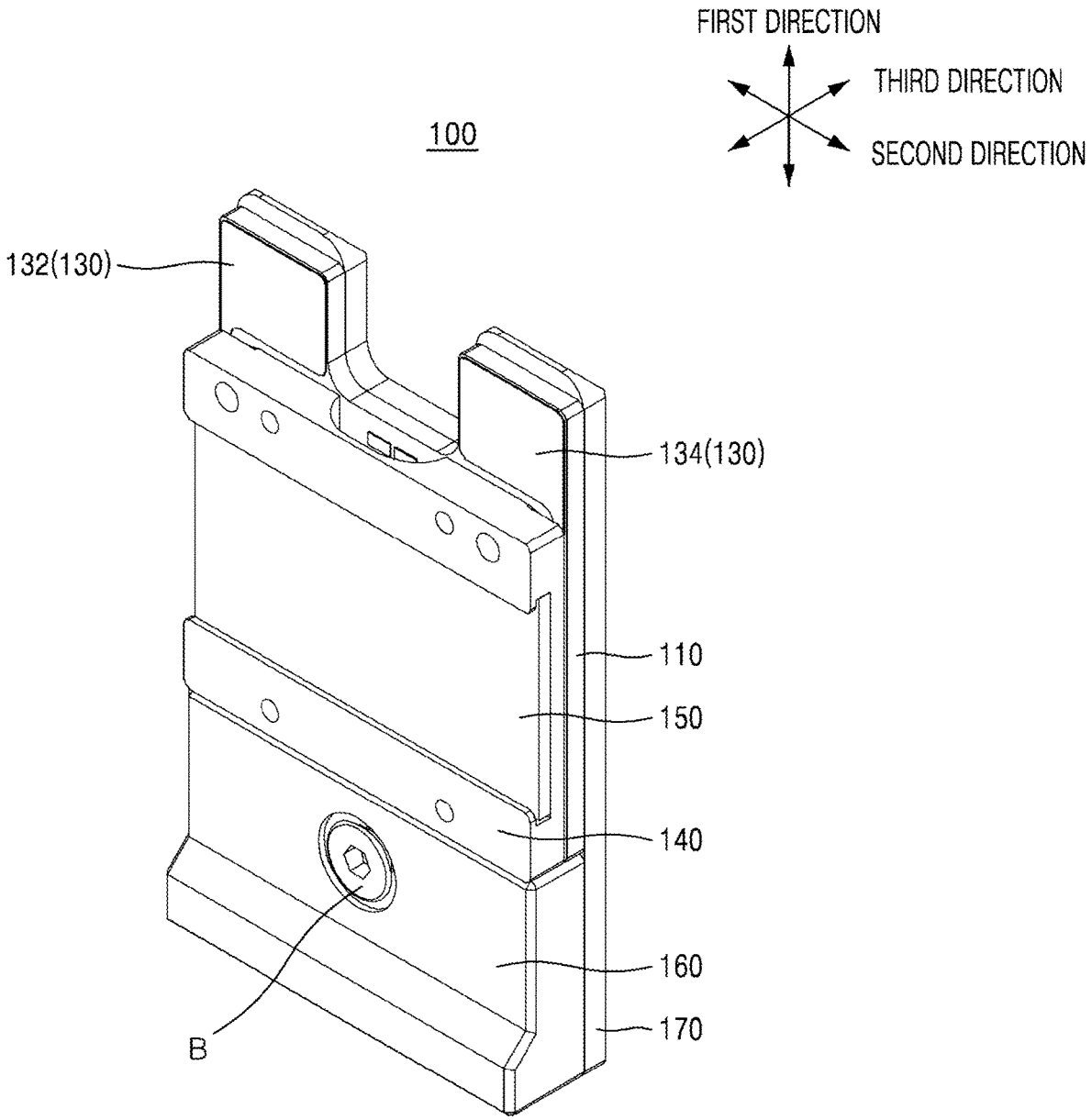
FIGS. 11 to 17 are a perspective view, an exploded perspective view, a front view, a plan view, a lateral view, a lateral cross-sectional view, and an exploded lateral view, respectively, of the light emitting module according to the first embodiment of the present disclosure of FIGS. 1 to 4 and FIGS. 7 to 10.

FIGS. 1 and 2 are a perspective view and a front view, respectively, of a light emitting module replacement type light emitting device according to an embodiment of the present disclosure. FIGS. 3 and 4 are a perspective view and a front view, respectively, of a state in which a housing and a power connector are removed from the light emitting module replacement type light emitting device of FIGS. 1 and 2. FIG. 5 is a perspective view illustrating a state in which a light emitting module according to a first embodiment is removed from the state of FIGS. 3 and 4, and FIG. 6 is an enlarged perspective view of a portion indicated by an alternate long and short dash line in FIG. 5. FIGS. 7 and 8 are state views illustrating a process of installing the light emitting module according to the first embodiment from the state of FIG. 6. FIGS. 9 and 10 are a front view and a lateral view, respectively, of a state in which the light emitting module according to the first embodiment is installed on a heat sink from the state of FIG. 6.

Referring to FIGS. 1 to 10, a light emitting module replacement type light emitting device 10 according to an embodiment may include one or more light emitting modules 100, a heat sink 200, and one or more binding clips 300. The light emitting module replacement type light emitting device 10 may further include at least one of a support member 400 and a housing 500. Also, the light emitting module replacement type light emitting device 10 may further include a power connector PW.

Each of the light emitting modules 100 may be attached to or detached from the heat sink 200 (see FIGS. 7 and 8).

The power connector PW may be coupled to a power cable which is electrically connected to an external power supply. Thus, external power may be supplied to the light emitting module 100.

Hereinafter, each configuration of the light emitting module replacement type light emitting device 10 will be described.

First Embodiment of Light Emitting Module

FIGS. 11 to 17 are a perspective view, an exploded perspective view, a front view, a plan view, a lateral view, a lateral cross-sectional view, and an exploded lateral view, respectively, of the light emitting module according to the first embodiment of the present disclosure of FIGS. 1 to 4 and FIGS. 7 to 10.

Referring to FIGS. 11 to 17, the light emitting module 100 according to the first embodiment of the present disclosure may include a substrate 110, one or more light emitting diodes 120, and a light emitting module terminal 130. Also, the light emitting module 100 may further include at least one of a frame 140, a protective glass 150, an auxiliary member 160, and a heat dissipation plate 170.

The substrate 110 may extend in a first direction (e.g., a vertical direction) and a second direction (e.g., a left-right direction) which intersects the first direction.

The light emitting diodes 120 may be mounted on one side surface (e.g., a front surface) of the substrate 110 in a third direction (e.g., a front-rear direction) which intersects the first direction and the second direction. The light emitting diodes 120 may be provided as one or more light emitting diodes 120 on the substrate 110.

The light emitting module terminal 130 may be provided on one side end (e.g., an upper side end) of the substrate 110 in the first direction. The light emitting module terminal 130 may be electrically connected to the one or more light emitting diodes 120.

The light emitting module terminal 130 may include a first light emitting module terminal 132 and a second light emitting module terminal 134.

The first light emitting module terminal 132 may be provided on one side end (e.g., a left side end) in the second direction of the one side end (e.g., the upper side end) of the substrate 110 in the first direction.

The second light emitting module terminal 134 may be provided on the other side end (e.g., a right side end) in the second direction of the one side end of the substrate 110 in the first direction.

The light emitting module terminal 130 may be formed of a copper foil formed on the substrate 110.

Accordingly, the light emitting module terminal 130 may be manufactured on the substrate 110 without being separately manufactured from the substrate 110. Thus, the light emitting module 100 can be easily manufactured with a low-cost, simple configuration.

The frame 140 may be coupled to the substrate 110. The frame 140 may be coupled to the substrate 110 and installed on the one side surface (e.g., the front surface) of the substrate 110 in the third direction. The frame 140 may include a through-hole H which passes through the frame 140 in the third direction. When the frame 140 is coupled to the substrate 110, the one or more light emitting diodes 120 may be positioned inside the through-hole H (see FIG. 16). The frame 140 may surround the one or more light emitting diodes 120. For example, when projected on a virtual plane extending in the first direction and the second direction, the frame 140 may surround the one or more light emitting diodes 120. When the frame 140 is coupled to the substrate 110, the frame 140 may protrude from the substrate 110 toward one side (e.g., a front side) in the third direction. The frame 140 may be open in the third direction.

Figure 17:
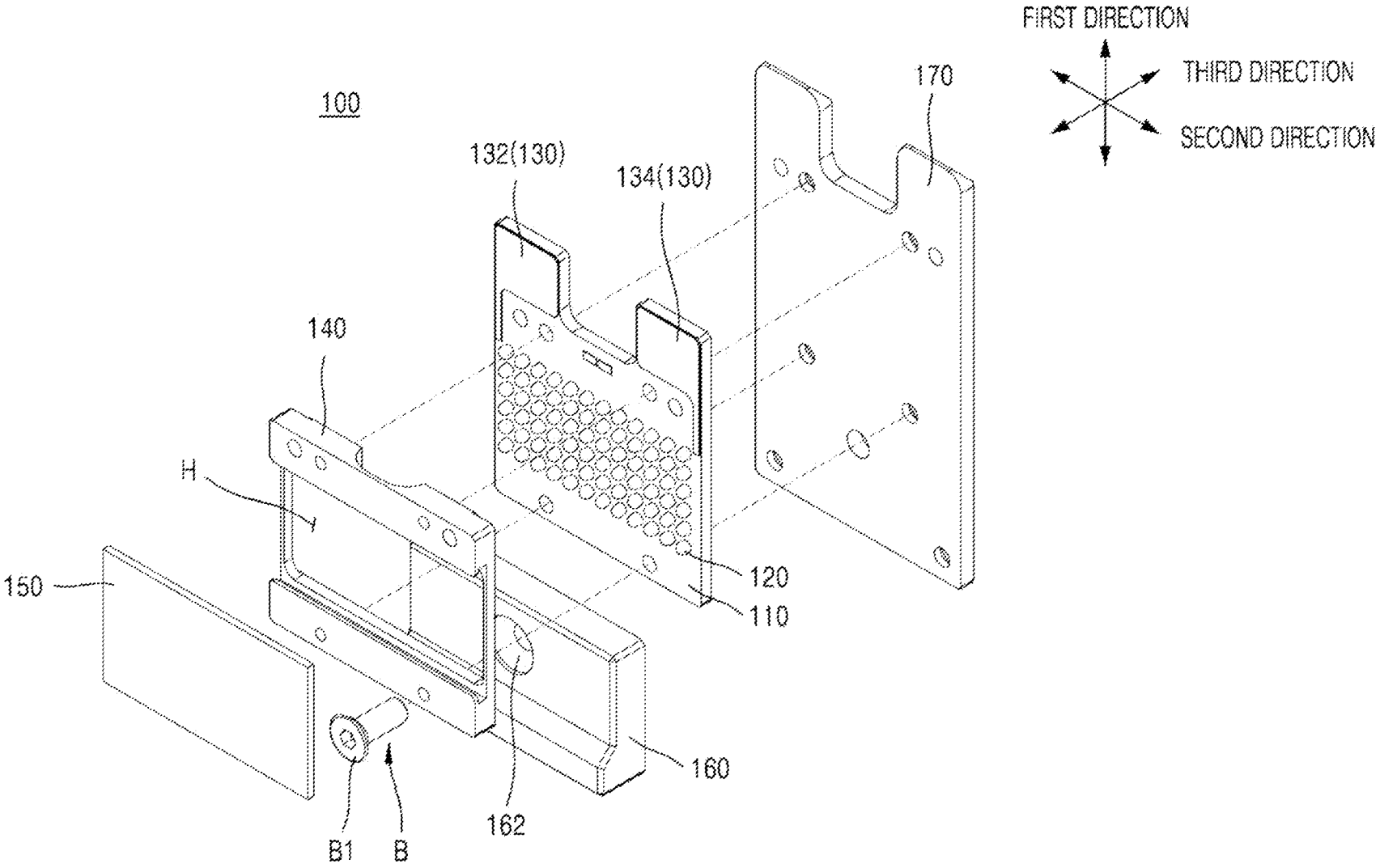

A guide groove 142 which extends in the second direction and into which the protective glass 150 is inserted may be formed in the frame 140 (see FIG. 17).

The protective glass 150 may be coupled to the frame 140. The protective glass 150 may block the through-hole H of the frame 140. Thus, the protective glass 150 may cover the one or more light emitting diodes 120.

Accordingly, when the light emitting module 100 is attached to or detached from the heat sink 200, damage to the light emitting diodes 120 or a connecting/coupling/bonding portion between the light emitting diodes 120 and the substrate 110 due to the light emitting diodes 120 being pressed can be prevented. Also, for example, the light emitting module 100 may be attached to or detached from the heat sink 200 while the protective glass 150 is pressed. Thus, anyone can easily attach or detach the light emitting module 100 to or from the heat sink 200 and easily replace a failed light emitting module 100 without special attention or training.

The protective glass 150 may be inserted into the guide groove 142 (see FIG. 17) of the frame 140 in the second direction.

Accordingly, the light emitting module 100 can be easily manufactured with a low-cost, simple configuration. Also, even when the protective glass 150 is pressed in the first direction when the light emitting module 100 is attached to or detached from the heat sink 200 in the first direction, the protective glass 150 may not be separated from the frame 140. Thus, the light emitting module 100 can be easily attached to or detached from the heat sink 200, and a failed light emitting module 100 can be easily replaced.

The auxiliary member 160 may be disposed on the other side (e.g., a lower side) of the substrate 110 in the first direction. The auxiliary member 160 may be directly coupled or indirectly coupled to the substrate 110.

Accordingly, the auxiliary member 160 may be held or pressed to attach or detach the light emitting module 100 to or from the heat sink 200. Thus, the light emitting module 100 can be easily attached to or detached from the heat sink 200, and during attachment or detachment of the light emitting module 100, damage to the light emitting diodes 120 or the connecting/coupling/bonding portion between the light emitting diodes 120 and the substrate 110 can be prevented.

For example, the auxiliary member 160 may be indirectly coupled to the substrate 110 by being coupled to the heat dissipation plate 170 which will be described below.

The auxiliary member 160 may further protrude toward one side in the third direction past the substrate 110. Also, the auxiliary member 160 may further protrude toward the one side in the third direction past the frame 140.

Accordingly, since the auxiliary member 160 can be easily held or pressed, the auxiliary member 160 may be held or pressed to more easily attach or detach the light emitting module 100 to or from the heat sink 200.

A first bolt through-hole 162 which passes through the auxiliary member 160 in the third direction may be formed in the auxiliary member 160.

Figure 16:
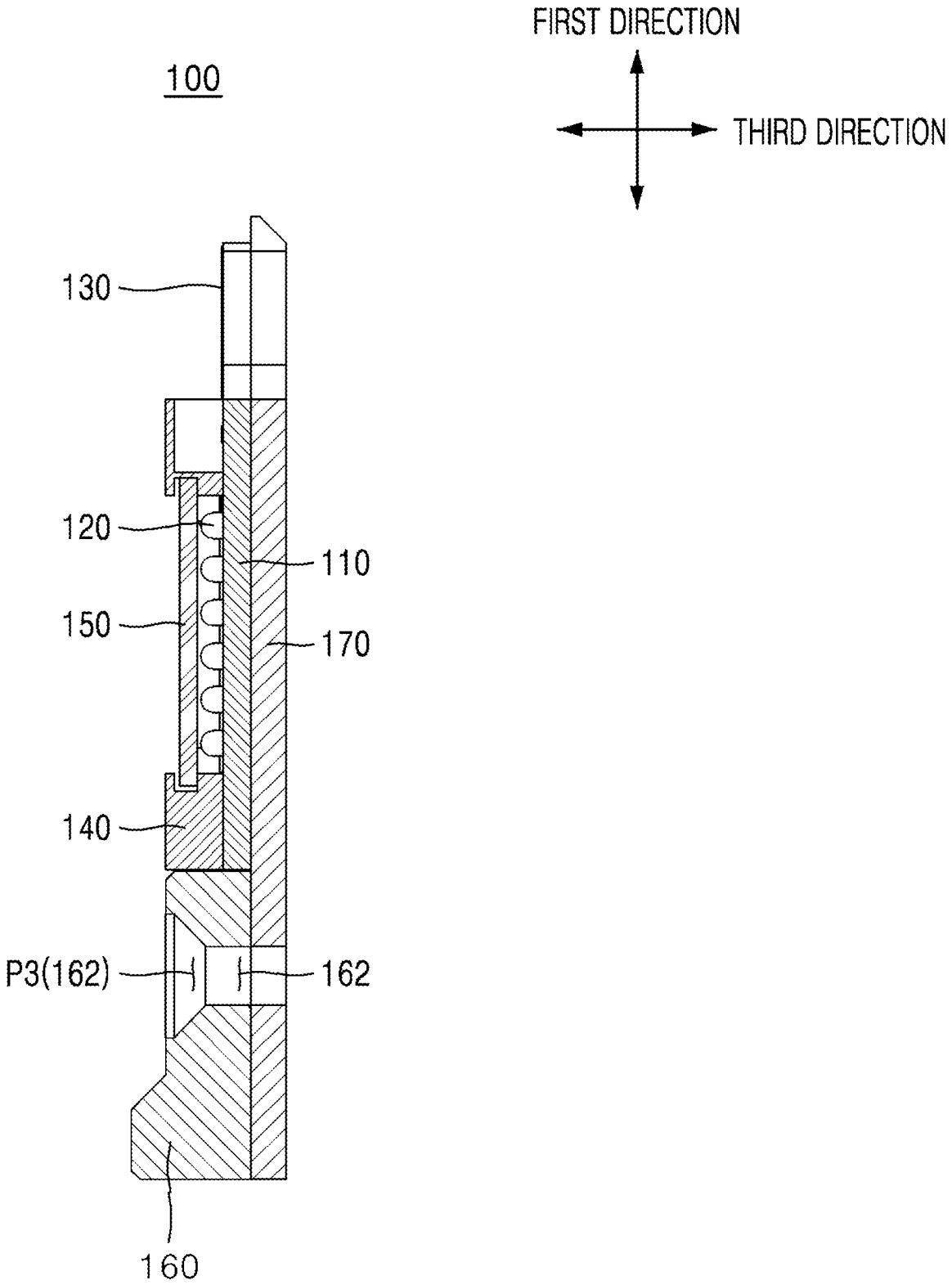

The first bolt through-hole 162 may include a third portion P3 whose cross-sectional area gradually decreases toward the other side (e.g., a rear side) in the third direction (see FIG. 16).

Figure 12:
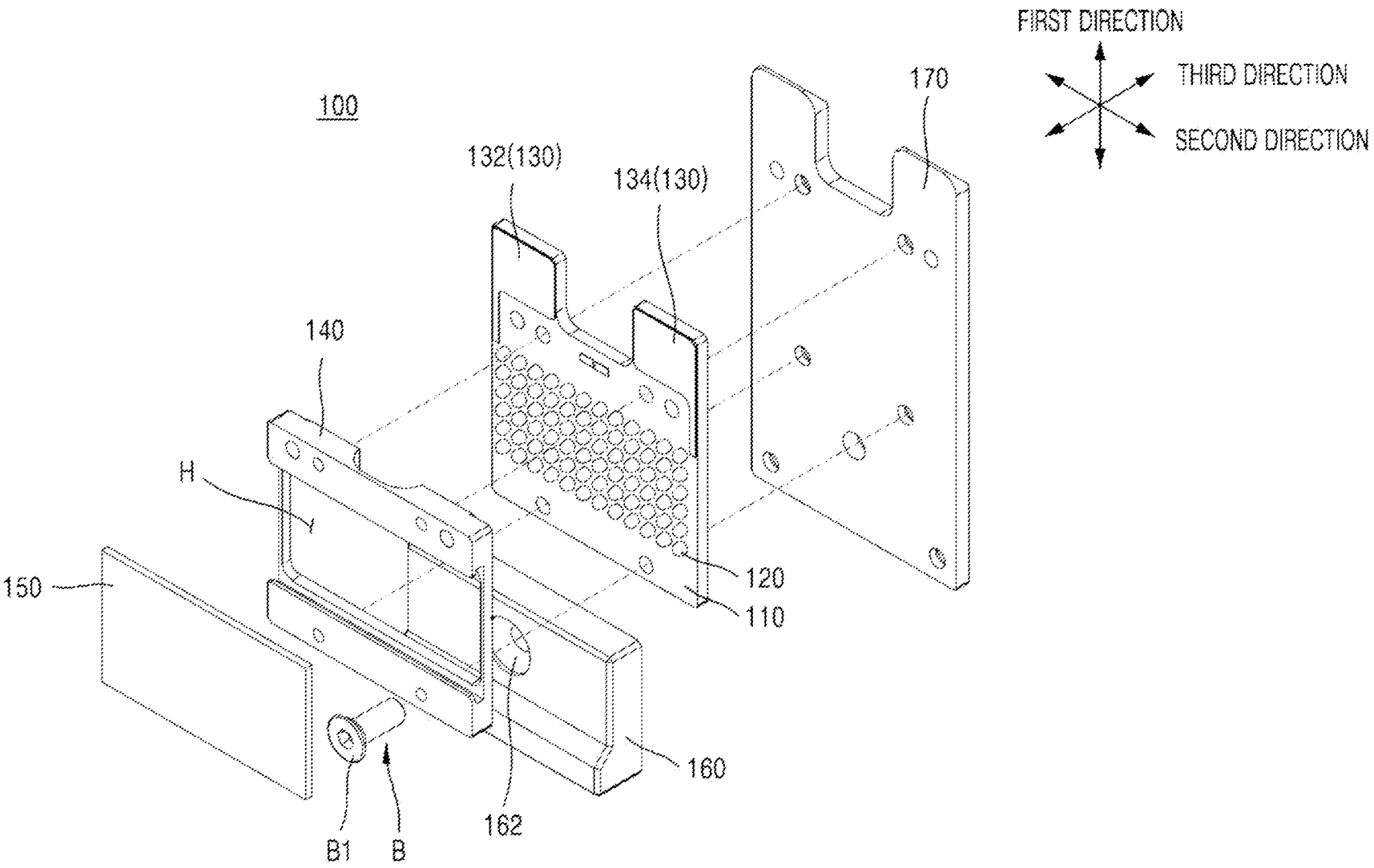
Figure 13:
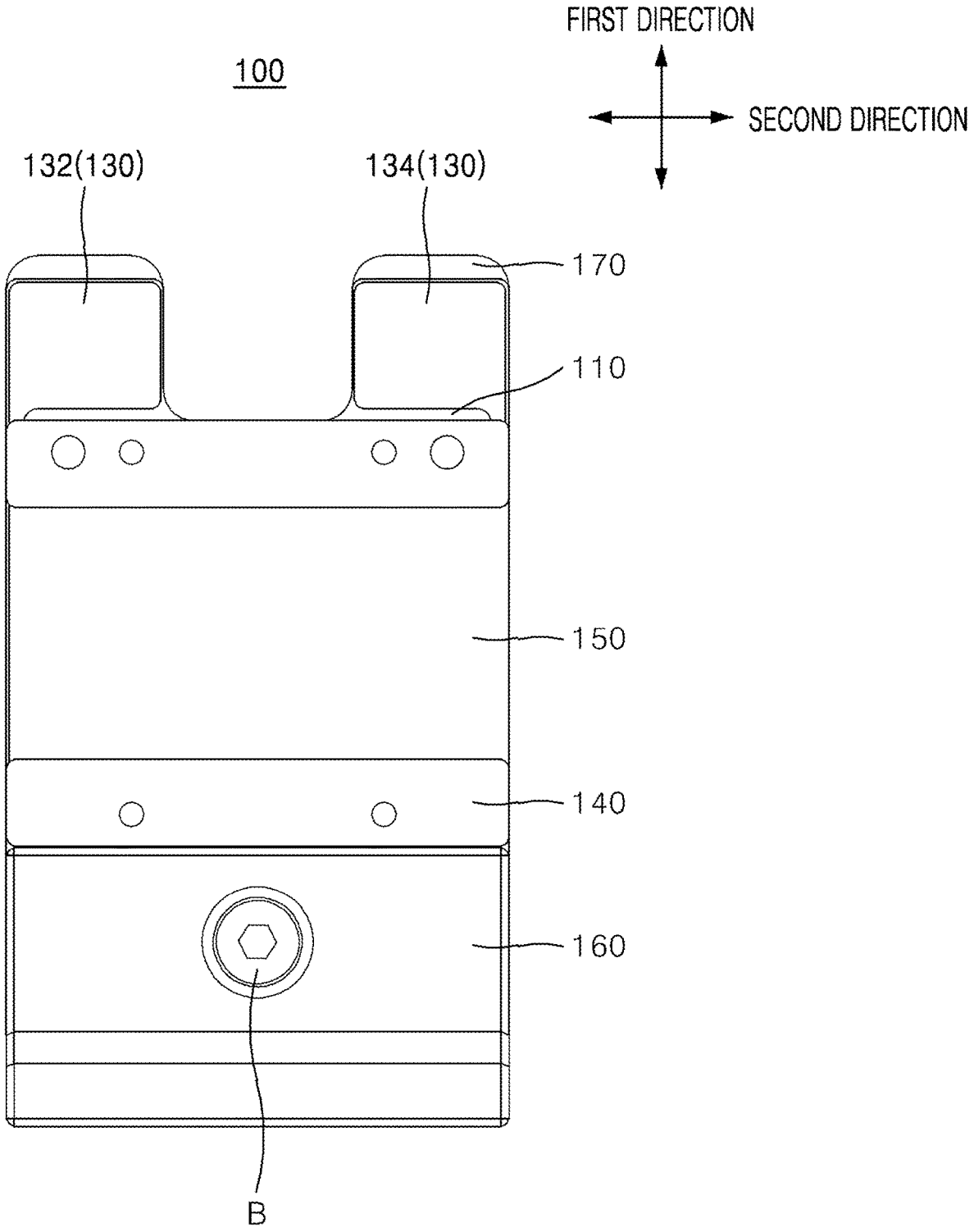
Figure 14:
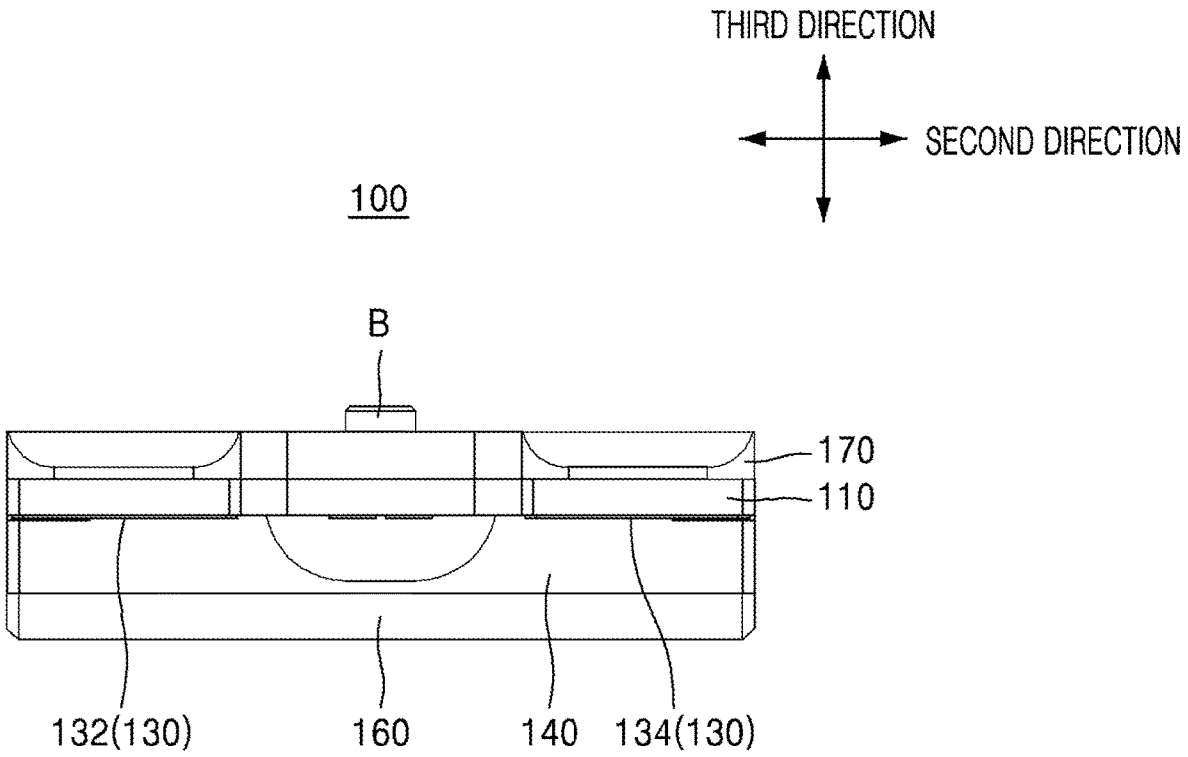
Figure 15:
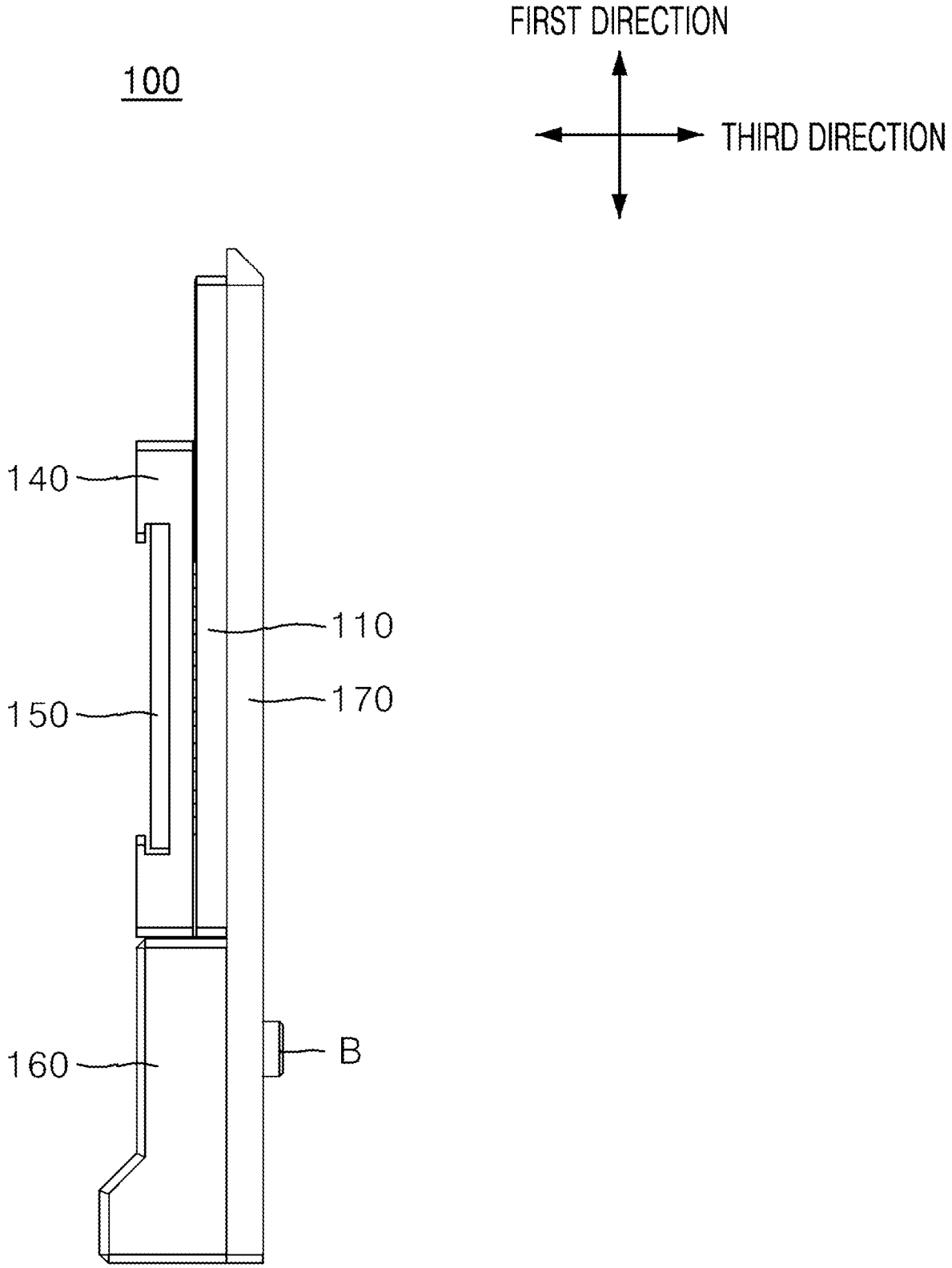

A position of the first bolt through-hole 162 in the second direction may correspond to an intermediate position between the first light emitting module terminal 132 and the second light emitting module terminal 134 (see FIG. 12).

The heat dissipation plate 170 may be coupled to the substrate 110 and the auxiliary member 160.

Specifically, for example, the other side surface (e.g., a back surface) of the substrate 110 in the third direction may be directly coupled to one side (e.g., an upper side) in the first direction of one side surface (e.g., a front surface) of the heat dissipation plate 170 in the third direction. In a case in which the frame 140 is disposed on the one side surface of the substrate 110 in the third direction, the same bolt (not illustrated) may be inserted into the heat dissipation plate 170 after passing through the frame 140 and the substrate 110 to couple the frame 140, the substrate 110, and the heat dissipation plate 170 (see FIGS. 12 and 17).

Also, the auxiliary member 160 may be coupled to the other side (e.g., a lower side) of the heat dissipation plate 170 in the first direction. Thus, the auxiliary member 160 may be indirectly coupled to the substrate 110 through the heat dissipation plate 170.

When the light emitting module terminal 130 is fitted between a connecting portion 320 of the binding clip 300 and a contact surface S of the heat sink 200, the other side surface (e.g., a back surface) of the heat dissipation plate 170 in the third direction may come in contact with the contact surface S.

Accordingly, with a low-cost, simple configuration, the auxiliary member 160 which is attached or detached together with the substrate 110 may be easily disposed at the other side of the substrate 110 in the first direction. Thus, the auxiliary member 160 may be held or pressed to easily attach or detach the light emitting module 100 to or from the heat sink 200. Also, since the heat dissipation plate 170 is disposed between the substrate 110 and the heat sink 200, cooling performance may not be reduced even when the substrate 110 does not come in direct contact with the heat sink 200.

[Heat Sink]

The heat sink 200 may include a first connector C1 and a second connector C2 (see FIG. 5).

The first connector C1 may be coupled to a water supply pipe, and the second connector C2 may be coupled to a water drain pipe. Thus, water (refrigerant) supplied into the heat sink 200 through the first connector C1 may, while circulating inside the heat sink 200, absorb heat dissipated from the one or more light emitting modules 100 in contact with the heat sink 200 and then be discharged to the outside of the heat sink 200 through the second connector C2.

The heat sink 200 may have the contact surface S, which is configured to come in contact with the light emitting module 100, formed on one end (e.g., a front end) in the third direction (see FIGS. 5 to 9).

As in the drawings, the contact surface S may be a flat surface which forms one end of the heat sink 200 in the third direction and extends in the first direction and the second direction. In a case in which the one end of the heat sink 200 in the third direction is not a flat surface, different from the drawings, the contact surface S may be a virtual plane that flatly extends in the first direction and the second direction and passes by the one end of the heat sink 200 in the third direction.

A first bolt insertion groove 202 may be formed in the heat sink 200 (see FIGS. 5 to 9).

In a case in which the light emitting module 100 is fitted between the binding clip 300 and the heat sink 200, the first bolt insertion groove 202 may be formed in a position that corresponds to the first bolt through-hole 162 of the auxiliary member 160. Also, in the case in which the light emitting module 100 is fitted between the binding clip 300 and the heat sink 200, the first bolt insertion groove 202 may communicate with the first bolt through-hole 162. The first bolt insertion groove 202 may extend in the third direction.

A bolt B may be inserted into the first bolt through-hole 162 and the first bolt insertion groove 202 toward the other side in the third direction (see FIG. 8).

Meanwhile, in a case in which the first bolt through-hole 162 of the auxiliary member 160 includes the above-described third portion P3 (see FIG. 16), a cross-sectional area of the other end (e.g., a rear end) of the first bolt through-hole 162 in the third direction may be larger than a cross-sectional area of the first bolt insertion groove 202. Here, the bolt B, which is inserted into the first bolt through-hole 162 and the first bolt insertion groove 202 toward the other side in the third direction, may have a head portion B1 including a shape that corresponds to the third portion P3 (see FIGS. 8, 12, and 17). For example, the bolt B may be a flat headed bolt.

Accordingly, using the bolt B, the light emitting module 100 can be easily fixed at a correct position.

Specifically, since the cross-sectional area of the other end of the first bolt through-hole 162 in the third direction is larger than the cross-sectional area of the first bolt insertion groove 202, when the light emitting module 100 is moved in a state in which the light emitting module 100 is brought into contact with the heat sink 200, the first bolt insertion groove 202 of the heat sink 200 may be easily exposed to the outside through the first bolt through-hole 162 of the auxiliary member 160 of the light emitting module 100. Therefore, the bolt B can be easily inserted into the first bolt insertion groove 202 after passing through the first bolt through-hole 162. Also, since the first bolt through-hole 162 includes the third portion P3 whose cross-sectional area gradually decreases toward the other side in the third direction and the bolt B having the head portion B1 including the shape that corresponds to the third portion P3 (e.g., a flat headed bolt) passes through the first bolt through-hole 162 is inserted into the first bolt insertion groove 202, when the bolt B is fastened, an inner side surface of the third portion P3 of the auxiliary member 160 may interfere with the head portion B1 of the bolt B, and the light emitting module 100 may move to a correct position.

As described above, in the case in which the position of the first bolt through-hole 162 in the second direction corresponds to the intermediate position between the first light emitting module terminal 132 and the second light emitting module terminal 134, the first bolt insertion groove 202 may also be formed in the position in the second direction that corresponds to the intermediate position.

Accordingly, since the first and second light emitting module terminals 132 and 134, which are positioned on both side ends in the second direction of one side end of the light emitting module 100 in the first direction, are bound to the first and second clip portions 300A and 300B coupled to the heat sink 200, the light emitting module 100 can be stably fixed to the heat sink 200 even when a single bolt B passes through and is inserted into, for example, the center of the auxiliary member 160 in the second direction that is positioned on the other side of the light emitting module 100 in the first direction to couple the light emitting module 100 to the heat sink 200. Thus, the number of fixers, such as a bolt, that should be used to fix the light emitting module 100 to the heat sink 200 can be reduced. Therefore, with a low-cost, simple configuration, the light emitting module 100 can be easily attached to or detached from the heat sink 200, and a failed light emitting module 100 can be easily replaced.

[Binding Clip]

The binding clip 300 may be provided as one or more binding clips 300. The binding clip 300 may be made of a conductive material. Each of the binding clips 300 may be electrically connected to the external power supply mentioned above.

Specifically, for example, a light emitting device terminal T electrically connected to the power connector PW described above may be, while in contact with the binding clip 300, penetrated by a bolt BB1 together with the binding clip 300 and be fixed to the heat sink 200 (see FIGS. 7 and 9).

The binding clip 300 may be configured to include a coupling portion 310 and the connecting portion 320 (see FIGS. 6 and 10).

The coupling portion 310 may be coupled to the heat sink 200.

The connecting portion 320 may be connected to the coupling portion 310. The connecting portion 320 may be positioned on or above the contact surface S of the heat sink 200.

The light emitting module terminal 130 of each of the light emitting modules 100 may be fitted between the connecting portion 320 of each of the binding clips 300 and the contact surface S of the heat sink 200. Accordingly, the light emitting module terminal 130 may come in contact with and be electrically connected to the binding clip 300, and the other side surface (e.g., a back surface) of the light emitting module 100 in the third direction may come in contact with the contact surface S.

Accordingly, with a low-cost, simple configuration, the light emitting module 100 can be easily attached to or detached from the heat sink 200, and a failed light emitting module 100 can be easily replaced. Thus, manufacturing costs and maintenance and management costs can be reduced. In particular, since the binding clip 300 binds one side end of the light emitting module 100 in the first direction, the number of fixers, such as a bolt, that should be used to fix the light emitting module 100 to the heat sink 200 can be reduced.

The binding clip 300 may be a leaf spring having elasticity.

Accordingly, the binding clip 300 can be easily configured with a low-cost, simple configuration.

In a case in which the plurality of binding clips 300 are disposed side by side in the second direction, the connecting portion 320 of each of the binding clips 300 may extend in the first direction or extend in a direction inclined in the third direction toward the first direction. Here, the light emitting module terminal 130 of each of the light emitting modules 100 may be fitted or removed in the first direction between the connecting portion 320 of each of the binding clips 300 and the contact surface S of the heat sink 200 (see FIGS. 7 and 8).

Accordingly, in the light emitting module replacement type light emitting device in which the plurality of light emitting modules 100 are installed side by side in the second direction, even when a gap between the light emitting modules 100 neighboring each other in the second direction is reduced to improve the luminous intensity uniformity in the second direction, each of the light emitting modules 100 can be easily attached to or detached from the heat sink 200, and a failed light emitting module 100 can be easily replaced. Thus, maintenance and management costs can be reduced while the uniformity of light radiated from the light emitting module replacement type light emitting device in the second direction is improved.

Each of the binding clips 300 may include the first clip portion 300A and the second clip portion 300B (see FIG. 6).

The first clip portion 300A and the second clip portion 300B may be disposed on the one side and the other side in the second direction. That is, the first clip portion 300A may be disposed on the one side of the second direction past the second clip portion 300B. The first clip portion 300A and the second clip portion 300B may be disposed a predetermined distance apart from each other in the second direction. The first clip portion 300A and the second clip portion 300B may each include the coupling portion 310 and the connecting portion 320.

The first clip portion 300A may come in contact with the first light emitting module terminal 132. Thus, the first light emitting module terminal 132 may come in contact with and be electrically connected to the first clip portion 300A.

The second clip portion 300B may come in contact with the second light emitting module terminal 134. Thus, the second light emitting module terminal 134 may come in contact with and be electrically connected to the second clip portion 300B.

Accordingly, when the first light emitting module terminal 132 and the second light emitting module terminal 134 of the light emitting module 100 are fitted between the first clip portion 300A and the heat sink 200 and between the second clip portion 300B and the heat sink 200, respectively, both side ends of the light emitting module 100 in the second direction can effectively and stably come in close contact with the heat sink 200. Thus, cooling performance of the light emitting module replacement type light emitting device can be easily improved with a low-cost, simple configuration.

Also, since the first and second clip portions 300A and 300B bind both side ends in the second direction of the one side end of the light emitting module 100 in the first direction, the number of fixers, such as a bolt, that should be used to fix the light emitting module 100 to the heat sink 200 can be reduced. Thus, with a low-cost, simple configuration, the light emitting module 100 can be easily attached to or detached from the heat sink 200, and a failed light emitting module 100 can be easily replaced.

Also, since the first and second light emitting module terminals 132 and 134 should be fitted between the first clip portion 300A and the heat sink 200 and between the second clip portion 300B and the heat sink 200, respectively, the light emitting module 100 may not be inclined at a slant when the light emitting module 100 is attached to or installed at the heat sink 200. Thus, the light emitting module 100 can be easily and correctly installed at the heat sink 200.

The coupling portion 310 may be disposed on or above one side surface (e.g., an upper surface) of the heat sink 200 in the first direction and may be coupled to the one side surface of the heat sink 200 in the first direction. Here, the connecting portion 320 may be bent from one end (e.g., a front end) of the coupling portion 310 in the third direction and extend toward the other side (e.g., a lower side) in the first direction or may extend in a direction inclined in the third direction toward the other side in the first direction.

Accordingly, the coupling portion 310 may not be coupled to one side surface (e.g., the contact surface) of the heat sink 200 in the third direction and may not be positioned on or above the one side surface (e.g., the contact surface) of the heat sink 200 in the third direction together with the connecting portion 320. That is, only the connecting portion 320 may be positioned on or above the one side surface of the heat sink 200 in the third direction. Thus, since a length of the heat sink 200 in the first direction can be reduced, the size and weight of the light emitting module replacement type light emitting device 10 can be reduced. Also, since a length of the binding clip 300 in the first direction can be reduced, a pressure applied to the light emitting module 100 in the third direction by an elastic restoration force of the binding clip 300 can be increased in a case in which the light emitting module 100 is fitted between the binding clip 300 and the heat sink 200. Thus, the light emitting module 100 can be stably fixed between the binding clip 300 and the heat sink 200 and come in close contact with the heat sink 200, and a state in which the light emitting module terminal 130 is electrically connected to the binding clip 300 can be stably maintained.

The connecting portion 320 may include a first portion P1 whose distance from the contact surface S in the third direction gradually decreases toward a distal end (e.g., a lower end) and a second portion P2 disposed at a distal side (e.g., a lower side) of the connecting portion 320 past the first portion P1 and whose distance from the contact surface S in the third direction gradually increases toward a distal end.

Here, the light emitting module terminal 130 may be inserted into a space between the second portion P2 and the contact surface S to be fitted between the connecting portion 320 and the contact surface S and come in contact with the distal end of the first portion P1 or a rear end of the second portion P2.

Accordingly, in the case in which the light emitting module 100 is fitted between the binding clip 300 and the heat sink 200, the first portion P1 can stably press the light emitting module 100 toward the other side in the third direction. Thus, the light emitting module 100 can be stably fixed between the binding clip 300 and the heat sink 200 and come in close contact with the heat sink 200, and the state in which the light emitting module terminal 130 of the light emitting module 100 is electrically connected to the binding clip 300 can be stably maintained.

Also, due to the second portion P2, the light emitting module 100 can be easily fitted between the binding clip 300 and the heat sink 200.

[Support Member]

The support member 400 may be coupled to face one side surface (e.g., an upper surface) of the heat sink 200 in the first direction. The support member 400 may extend in the third direction and protrude toward one side (e.g., a front side) in the third direction past the contact surface S of the heat sink 200 (see FIGS. 6 to 8 and FIG. 10).

Here, the coupling portion 310 may be coupled to one side surface of the support member 400 in the first direction. Also, the coupling portion 310 may extend in the third direction along the support member 400 while in contact with the support member 400 to protrude toward the one side in the third direction past the contact surface S of the heat sink 200 (see FIGS. 6 to 8 and FIG. 10).

Also, here, the connecting portion 320 may be bent from the one end (e.g., the front end) of the coupling portion 310 in the third direction to extend toward the other side (e.g., the lower side) in the first direction or extend in the direction inclined in the third direction toward the other side in the first direction. Also, the connecting portion 320 may include the first portion P1 which extends at a slant at the other side (e.g., a rear side) in the third direction toward the other side in the first direction (see FIGS. 6 to 8 and FIG. 10).

Accordingly, since the coupling portion 310 can protrude toward the one side in the third direction past the contact surface S, an angle at which the first portion P1 of the connecting portion 320 is inclined toward the other side in the third direction with respect to the other side in the first direction can be increased. Thus, a pressure applied to the light emitting module 100 toward the other side in the third direction by the first portion P1 can be increased in a case in which the light emitting module 100 is fitted between the binding clip 300 and the heat sink 200. Therefore, the light emitting module 100 can be stably fixed between the binding clip 300 and the heat sink 200 and come in close contact with the heat sink 200, and the state in which the light emitting module terminal 130 of the light emitting module 100 is electrically connected to the binding clip 300 can be stably maintained.

Also, since the support member 400 protrudes toward the one side in the third direction past the contact surface S together with the coupling portion 310, even when the coupling portion 310 protrudes toward the one side in the third direction past the contact surface S, the coupling portion 310 can be stably supported by the support member 400. Thus, the binding clip 300 and the support member 400 can be prevented from being uncoupled, and the binding clip 300 can be prevented from being deformed. For example, when the light emitting module 100 is removed from between the binding clip 300 and the heat sink 200, the support member 400 can stably support the binding clip 300.

Second Embodiment of Light Emitting Module

Figure 18:
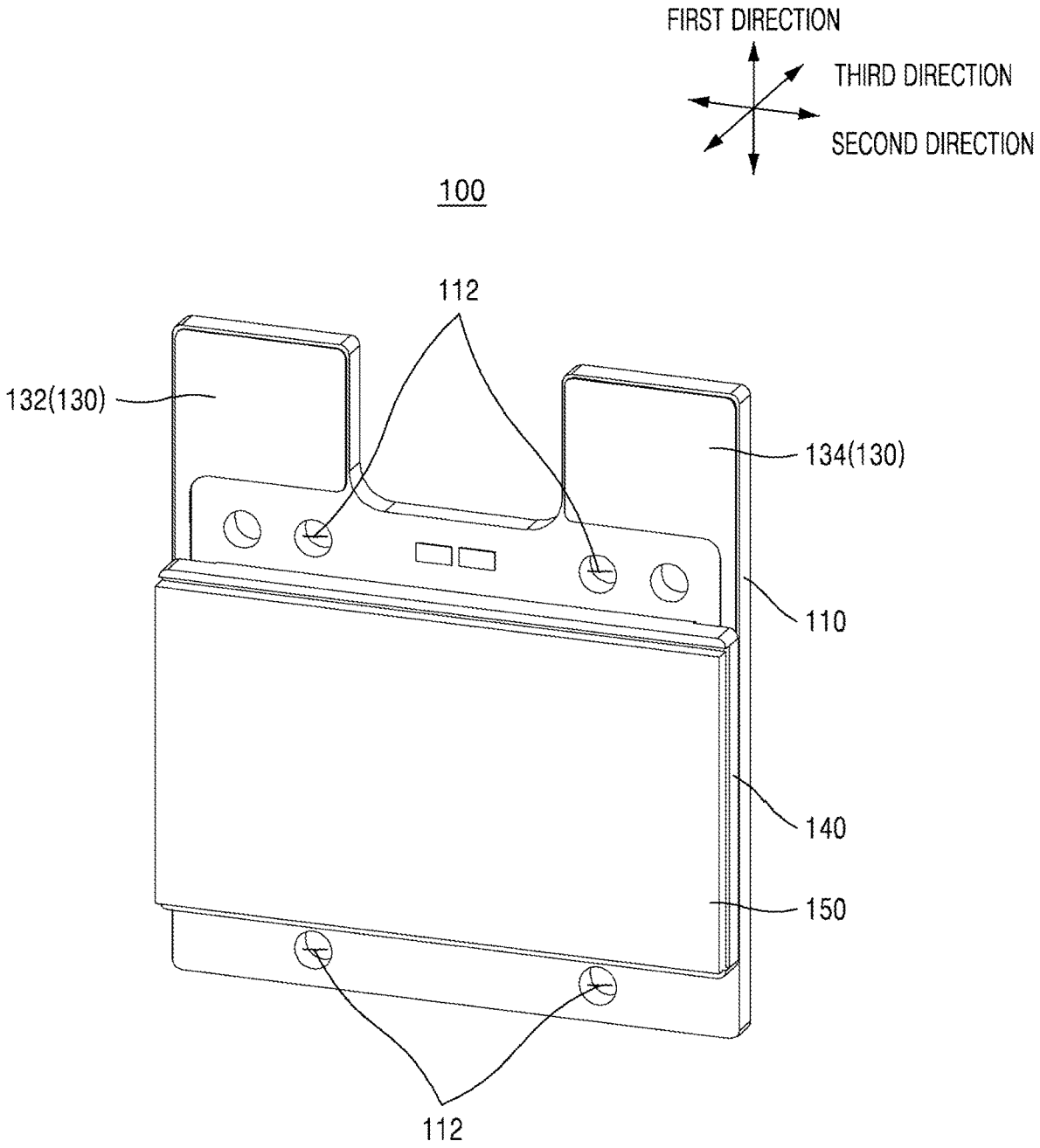
FIGS. 18 and 19 are a perspective view and an exploded perspective view, respectively, of a light emitting module according to a second embodiment of the present disclosure.
Figure 19:
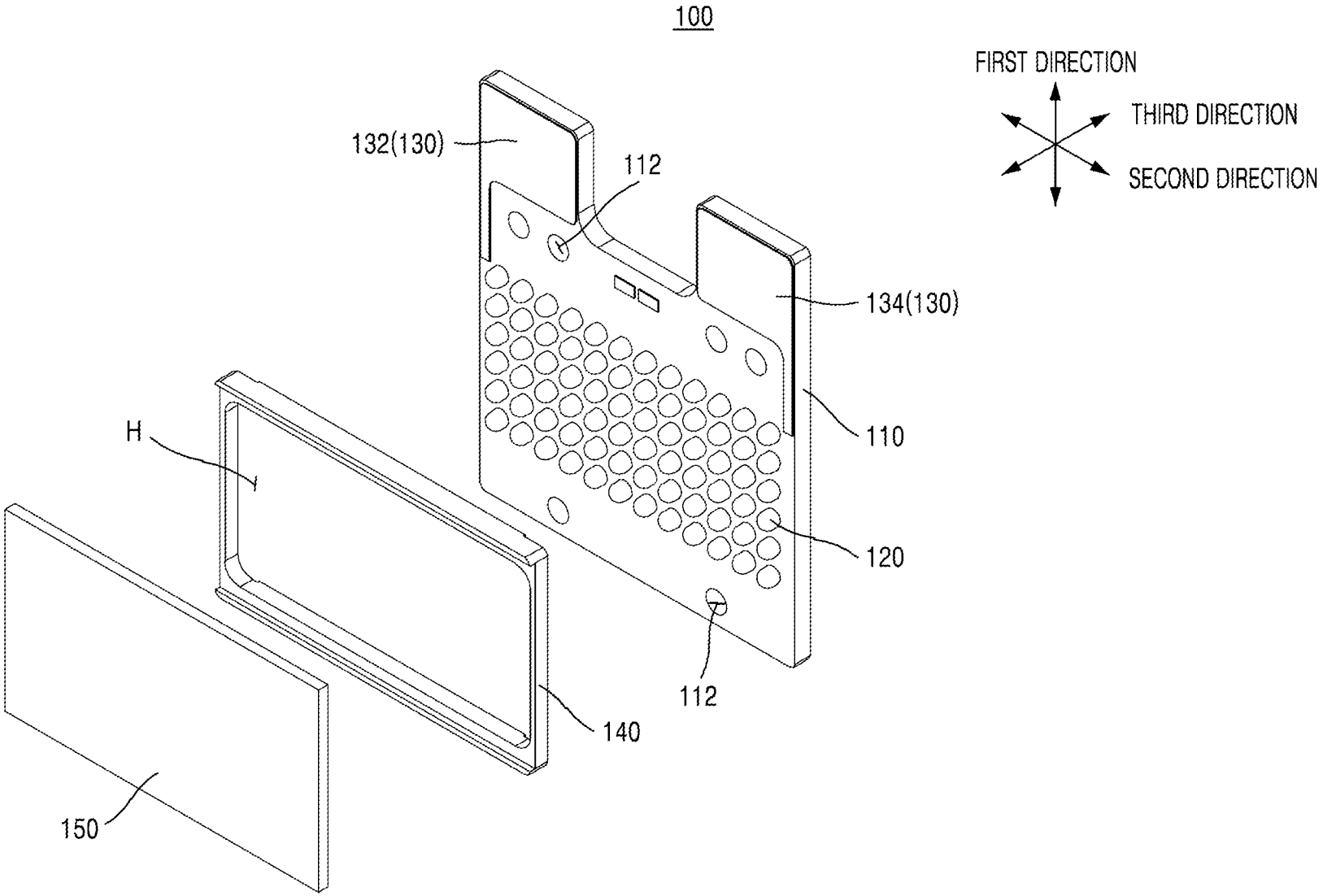
Figure 20:
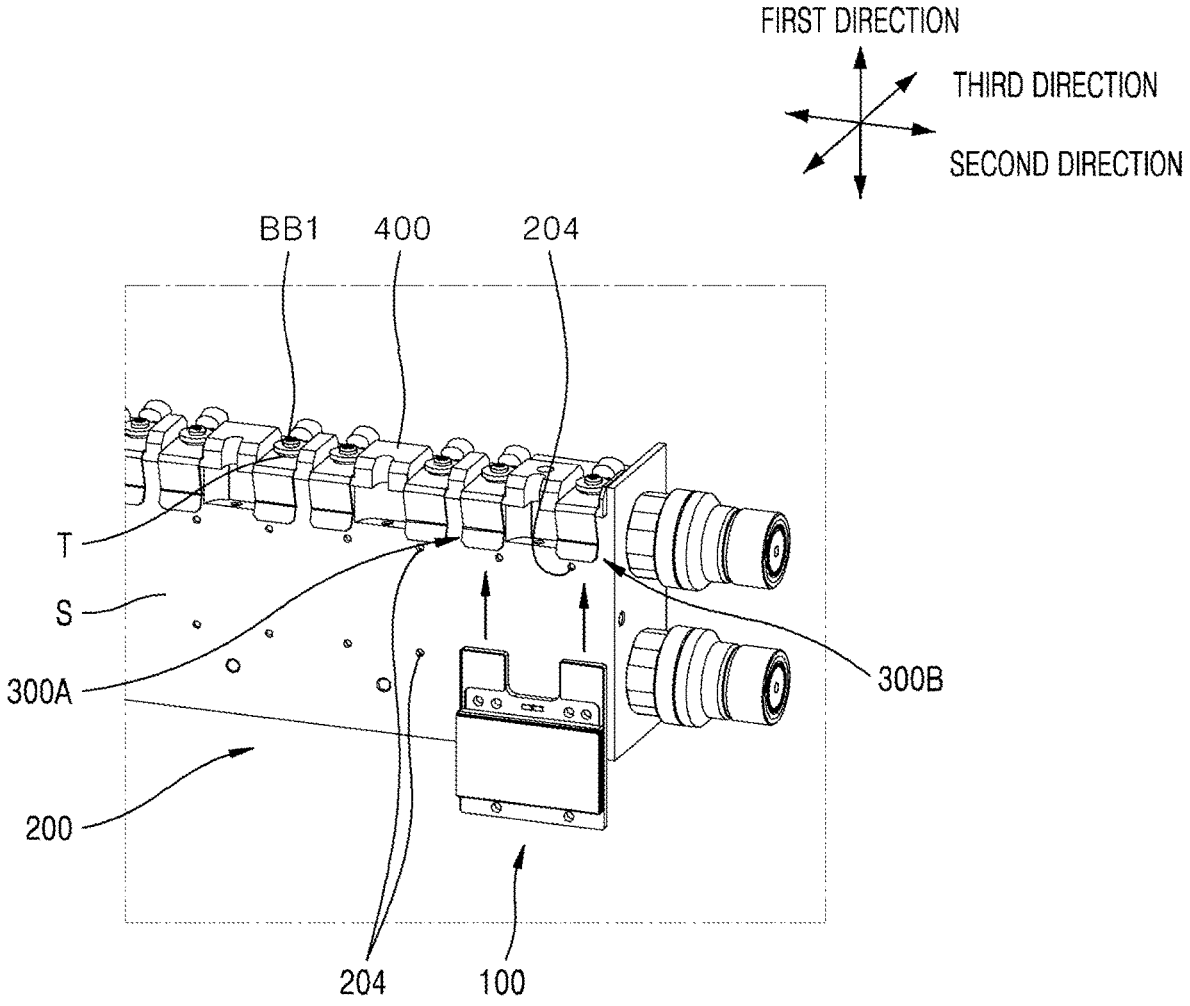
FIGS. 20 and 21 are state views illustrating a process of installing the light emitting module according to the second embodiment from the state of FIG. 6.
Figure 21:
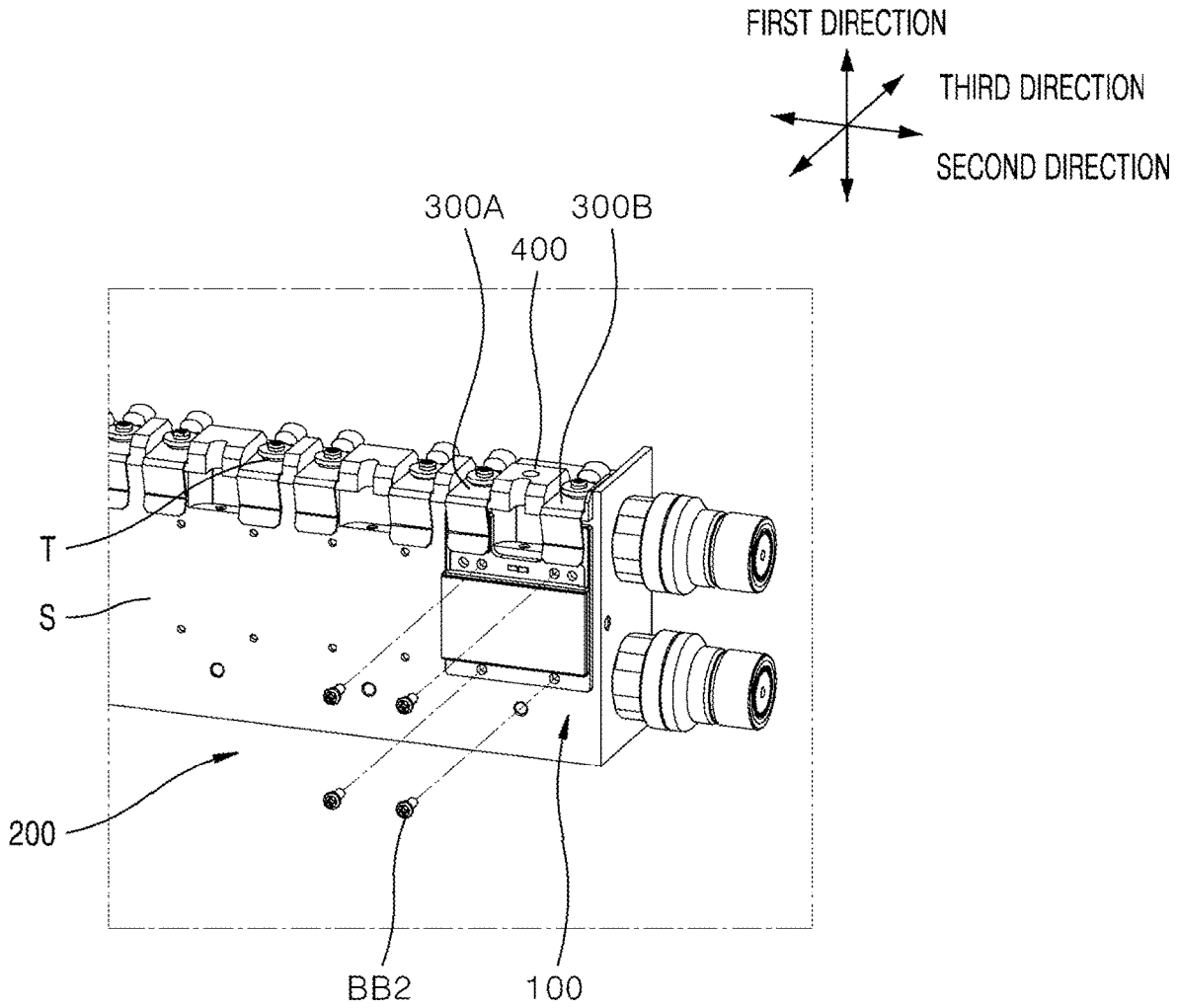
Figure 22:
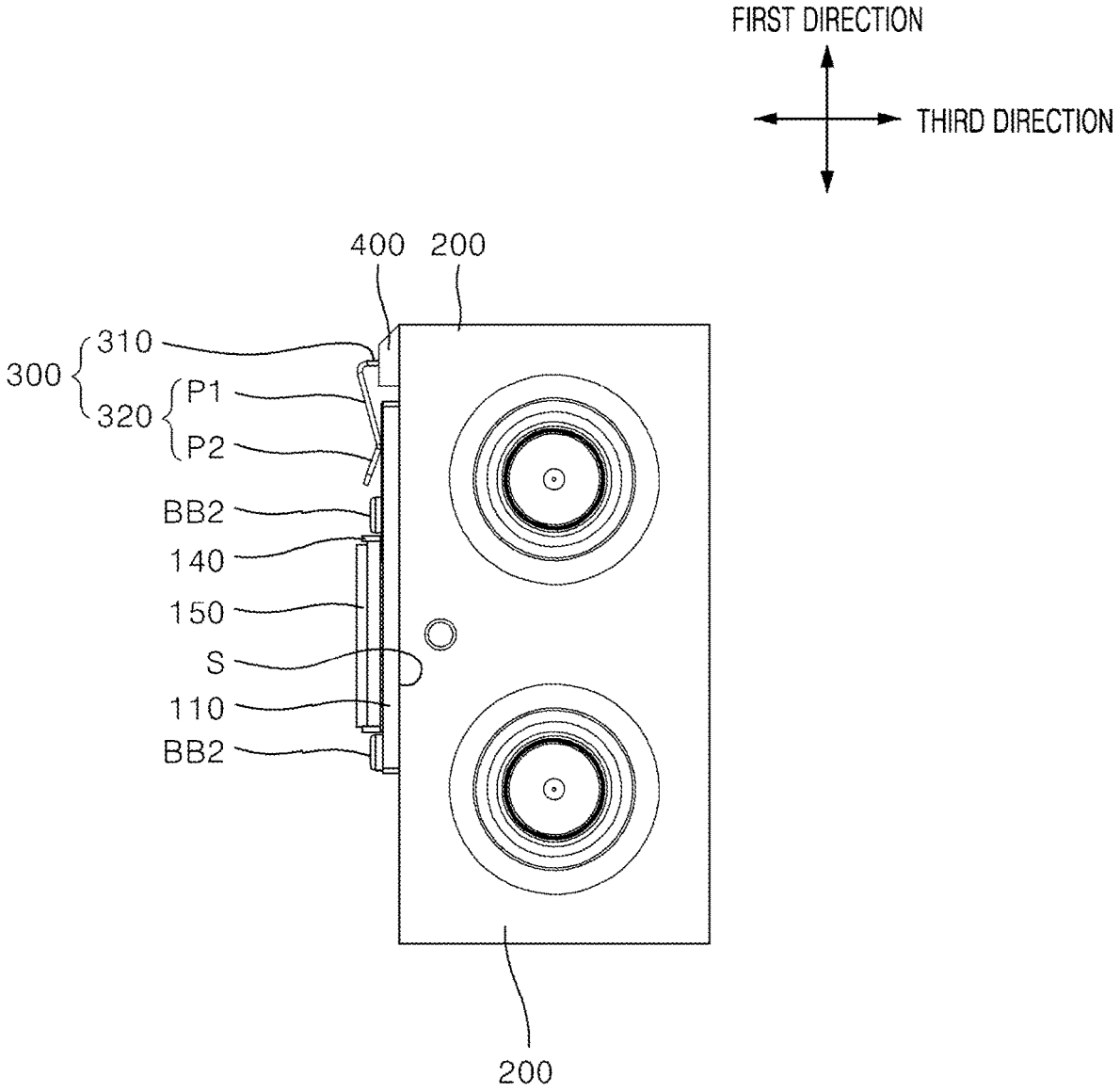
FIG. 22 is a lateral view illustrating a state in which the light emitting module according to the second embodiment is installed on the heat sink from the state of FIG. 6.

FIGS. 18 and 19 are a perspective view and an exploded perspective view, respectively, of a light emitting module according to a second embodiment of the present disclosure. FIGS. 20 and 21 are state views illustrating a process of installing the light emitting module according to the second embodiment from the state of FIG. 6. FIG. 22 is a lateral view illustrating a state in which the light emitting module according to the second embodiment is installed on the heat sink from the state of FIG. 6.

Referring to FIGS. 18 and 19, like the light emitting module 100 according to the first embodiment described above, a light emitting module 100 according to the second embodiment may include a substrate 110, one or more light emitting diodes 120, and a light emitting module terminal 130. Also, like the light emitting module 100 according to the first embodiment described above, the light emitting module 100 according to the second embodiment may further include a frame 140 and a protective glass 150.

Referring to FIGS. 20 to 22, like the light emitting module 100 according to the first embodiment described above, the light emitting module 100 according to the second embodiment may be attached to or detached from the heat sink 200.

Differences from the light emitting module 100 according to the first embodiment described above are as follows.

One or more second bolt through-holes 112 passing through the substrate 110 in the third direction may be formed in the substrate 110 (see FIGS. 18 and 19).

One or more second bolt insertion grooves 204 may be formed in the heat sink 200 (see FIGS. 20 and 21).

In a case in which the light emitting module 100 is fitted between the binding clip 300 and the heat sink 200, the second bolt insertion grooves 204 may be formed at positions corresponding to the second bolt through-holes 112 of the substrate 110. Also, in the case in which the light emitting module 100 is fitted between the binding clip 300 and the heat sink 200, the second bolt insertion grooves 204 may communicate with the second bolt through-holes 112. The second bolt insertion grooves 204 may extend in the third direction.

A bolt BB2 may be inserted into the second bolt through-hole 112 and the second bolt insertion groove 204 toward the other side in the third direction (see FIG. 21).

When the light emitting module terminal 130 is fitted between the connecting portion 320 of the binding clip 300 and the contact surface S of the heat sink 200, the other side surface (e.g., a back surface) of the substrate 110 in the third direction may come in contact with the contact surface S (see FIG. 22).

According to embodiments of the present disclosure, a light emitting module replacement type light emitting device 10 may include: one or more light emitting modules 100 configured to include a substrate 110 extending in a first direction and a second direction which intersects the first direction, one or more light emitting diodes 120 mounted on one side surface of the substrate 110 in a third direction which intersects the first direction and the second direction, and a light emitting module terminal 130 provided on one side end of the substrate 110 in the first direction and electrically connected to the one or more light emitting diodes 120; a heat sink 200 having a contact surface S, which is configured to come in contact with the light emitting modules 100, provided on one end in the third direction; and one or more binding clips 300, which are configured to include a coupling portion 310 coupled to the heat sink 200 and a connecting portion 320 connected to the coupling portion 310 and positioned on or above the contact surface S, and which are electrically connected to an external power supply. The light emitting module terminal 130 of each of the light emitting modules 100 may be fitted between the connecting portion 320 of each of the binding clips 300 and the contact surface S of the heat sink 200, and accordingly, the light emitting module terminal 130 may come in contact with and be electrically connected to the binding clip 300, and the other side surface of the light emitting module 100 in the third direction may come in contact with the contact surface S.

Accordingly, with a low-cost, simple configuration, the light emitting module 100 can be easily attached to or detached from the heat sink 200, and a failed light emitting module 100 can be easily replaced. Thus, manufacturing costs and maintenance and management costs can be reduced. In particular, since the binding clip 300 binds one side end of the light emitting module 100 in the first direction, the number of fixers, such as a bolt, that should be used to fix the light emitting module 100 to the heat sink 200 can be reduced.

According to an embodiment of the present disclosure, in the light emitting module replacement type light emitting device 10, the binding clip 300 and the light emitting module 100 may be provided as a plurality of binding clips 300 and a plurality of light emitting modules 100. The plurality of binding clips 300 may be disposed side by side in the second direction. The connecting portion 320 of each of the binding clips 300 may extend in the first direction or extend in a direction inclined in the third direction toward the first direction. The light emitting module terminal 130 of each of the light emitting modules 100 may be fitted or removed in the first direction between the connecting portion 320 of each of the binding clips 300 and the contact surface S of the heat sink 200.

Accordingly, in the light emitting module replacement type light emitting device in which the plurality of light emitting modules 100 are installed side by side in the second direction, even when a gap between the light emitting modules 100 neighboring each other in the second direction is reduced to improve the luminous intensity uniformity in the second direction, each of the light emitting modules 100 can be easily attached to or detached from the heat sink 200, and a failed light emitting module 100 can be easily replaced. Thus, maintenance and management costs can be reduced while the uniformity of light radiated from the light emitting module replacement type light emitting device in the second direction is improved.

According to an embodiment of the present disclosure, in each of the light emitting modules 100, the light emitting module terminal 130 may include a first light emitting module terminal 132 and a second light emitting module terminal 134 each provided on one side end in the second direction of the one side end of the substrate 110 in the first direction and the other side end in the second direction of the one side end of the substrate 110 in the first direction. Each of the binding clips 300 may include a first clip portion 300A and a second clip portion 300B. The first clip portion 300A and the second clip portion 300B may be disposed a predetermined distance apart from each other in the second direction on one side and the other side in the second direction and may each include the coupling portion 310 and the connecting portion 320. The first light emitting module terminal 132 may come in contact with and be electrically connected to the first clip portion 300A, and the second light emitting module terminal 134 may come in contact with and be electrically connected to the second clip portion 300B.

Accordingly, when the first light emitting module terminal 132 and the second light emitting module terminal 134 of the light emitting module 100 are fitted between the first clip portion 300A and the heat sink 200 and between the second clip portion 300B and the heat sink 200, respectively, both side ends of the light emitting module 100 in the second direction can effectively and stably come in close contact with the heat sink 200. Thus, cooling performance of the light emitting module replacement type light emitting device can be easily improved with a low-cost, simple configuration.

Also, since the first and second clip portions 300A and 300B bind both side ends in the second direction of the one side end of the light emitting module 100 in the first direction, the number of fixers, such as a bolt, that should be used to fix the light emitting module 100 to the heat sink 200 can be reduced. Thus, with a low-cost, simple configuration, the light emitting module 100 can be easily attached to or detached from the heat sink 200, and a failed light emitting module 100 can be easily replaced.

Also, since the first and second light emitting module terminals 132 and 134 should be fitted between the first clip portion 300A and the heat sink 200 and between the second clip portion 300B and the heat sink 200, respectively, the light emitting module 100 may not be inclined at a slant when the light emitting module 100 is attached to or installed at the heat sink 200. Thus, the light emitting module 100 can be easily and correctly installed at the heat sink 200.

According to an embodiment of the present disclosure, the binding clip 300 may be a leaf spring having elasticity.

Accordingly, the binding clip 300 can be easily configured with a low-cost, simple configuration.

According to an embodiment of the present disclosure, the coupling portion 310 may be disposed on or above one side surface of the heat sink 200 in the first direction and may be coupled to the one side surface of the heat sink 200 in the first direction. The connecting portion 320 may be bent from one end of the coupling portion 310 in the third direction and extend toward the other side in the first direction or may extend in a direction inclined in the third direction toward the other side in the first direction.

Accordingly, the coupling portion 310 may not be coupled to one side surface (e.g., the contact surface) of the heat sink 200 in the third direction and may not be positioned on or above the one side surface (e.g., the contact surface) of the heat sink 200 in the third direction together with the connecting portion 320. Thus, since a length of the heat sink 200 in the first direction can be reduced, the size and weight of the light emitting module replacement type light emitting device 10 can be reduced. Also, since a length of the binding clip 300 in the first direction can be reduced, a pressure applied to the light emitting module 100 in the third direction by an elastic restoration force of the binding clip 300 can be increased in a case in which the light emitting module 100 is fitted between the binding clip 300 and the heat sink 200. Thus, the light emitting module 100 can be stably fixed between the binding clip 300 and the heat sink 200 and come in close contact with the heat sink 200, and a state in which the light emitting module terminal 130 is electrically connected to the binding clip 300 can be stably maintained.

According to an embodiment of the present disclosure, the light emitting module replacement type light emitting device 10 may further include a support member 400 which is coupled to face the one side surface of the heat sink 200 in the first direction, extends in the third direction, and protrudes toward one side in the third direction past the contact surface S. The coupling portion 310 may be coupled to one side surface of the support member 400 in the first direction and may extend in the third direction along the support member 400 while in contact with the support member 400 to protrude toward the one side in the third direction past the contact surface S. The connecting portion 320 is bent from the one end of the coupling portion 310 in the third direction to extend toward the other side in the first direction or extend in the direction inclined in the third direction toward the other side in the first direction and includes a first portion P1 which extends at a slant at the other side in the third direction toward the other side in the first direction.

Accordingly, since the coupling portion 310 can protrude toward the one side in the third direction past the contact surface S, an angle at which the first portion P1 of the connecting portion 320 is inclined toward the other side in the third direction with respect to the other side in the first direction can be increased. Thus, a pressure applied to the light emitting module 100 toward the other side in the third direction by the first portion P1 can be increased in a case in which the light emitting module 100 is fitted between the binding clip 300 and the heat sink 200. Therefore, the light emitting module 100 can be stably fixed between the binding clip 300 and the heat sink 200 and come in close contact with the heat sink 200, and the state in which the light emitting module terminal 130 of the light emitting module 100 is electrically connected to the binding clip 300 can be stably maintained.

Also, since the support member 400 protrudes toward the one side in the third direction past the contact surface S together with the coupling portion 310, even when the coupling portion 310 protrudes toward the one side in the third direction past the contact surface S, the coupling portion 310 can be stably supported by the support member 400. Thus, the binding clip 300 and the support member 400 can be prevented from being uncoupled, and the binding clip 300 can be prevented from being deformed. For example, when the light emitting module 100 is removed from between the binding clip 300 and the heat sink 200, the support member 400 can stably support the binding clip 300.

According to an embodiment of the present disclosure, the connecting portion 320 may include the first portion P1 whose distance from the contact surface S in the third direction gradually decreases toward a distal end and a second portion P2 disposed at a distal side of the connecting portion 320 past the first portion P1 and whose distance from the contact surface S in the third direction gradually increases toward a distal end. The light emitting module terminal 130 may be inserted into a space between the second portion P2 and the contact surface S of the heat sink 200 to be fitted between the connecting portion 320 and the contact surface S and come in contact with the distal end of the first portion P1 or a rear end of the second portion P2.

Accordingly, in the case in which the light emitting module 100 is fitted between the binding clip 300 and the heat sink 200, the first portion P1 can stably press the light emitting module 100 toward the other side in the third direction. Thus, the light emitting module 100 can be stably fixed between the binding clip 300 and the heat sink 200 and come in close contact with the heat sink 200, and the state in which the light emitting module terminal 130 of the light emitting module 100 is electrically connected to the binding clip 300 can be stably maintained.

Also, due to the second portion P2, the light emitting module 100 can be easily fitted between the binding clip 300 and the heat sink 200.

According to an embodiment of the present disclosure, the light emitting module 100 may further include a frame 140 coupled to the substrate 110 and configured to surround the one or more light emitting diodes 120 and protrude from the substrate 110 toward the one side in the third direction and a protective glass 150 coupled to the frame 140 and configured to cover the one or more light emitting diodes 120.

Accordingly, when the light emitting module 100 is attached to or detached from the heat sink 200, damage to the light emitting diodes 120 or a connecting/coupling/bonding portion between the light emitting diodes 120 and the substrate 110 due to the light emitting diodes 120 being pressed can be prevented. Also, for example, the light emitting module 100 may be attached to or detached from the heat sink 200 while the protective glass 150 is pressed. Thus, anyone can easily attach or detach the light emitting module 100 to or from the heat sink 200 and easily replace a failed light emitting module 100 without special attention or training.

According to an embodiment of the present disclosure, a guide groove 142 which extends in the second direction and into which the protective glass 150 is inserted may be formed in the frame 140. The protective glass 150 may be inserted into the guide groove 142 in the second direction.

Accordingly, the light emitting module 100 can be easily manufactured with a low-cost, simple configuration. Also, even when the protective glass 150 is pressed in the first direction when the light emitting module 100 is attached to or detached from the heat sink 200 in the first direction, the protective glass 150 may not be separated from the frame 140. Thus, the light emitting module 100 can be easily attached to or detached from the heat sink 200, and a failed light emitting module 100 can be easily replaced.

According to an embodiment of the present disclosure, the light emitting module terminal 130 may be formed of a copper foil formed on the substrate 110.

Accordingly, the light emitting module terminal 130 can be manufactured on the substrate 110 without being separately manufactured from the substrate 110. Thus, the light emitting module 100 can be easily manufactured with a low-cost, simple configuration.

According to an embodiment of the present disclosure, the light emitting module 100 may further include an auxiliary member 160 disposed at the other side of the substrate 110 in the first direction and directly coupled or indirectly coupled to the substrate 110.

Accordingly, the auxiliary member 160 may be held or pressed to attach or detach the light emitting module 100 to or from the heat sink 200. Thus, the light emitting module 100 can be easily attached to or detached from the heat sink 200, and during attachment or detachment of the light emitting module 100, damage to the light emitting diodes 120 or the connecting/coupling/bonding portion between the light emitting diodes 120 and the substrate 110 can be prevented.

According to an embodiment of the present disclosure, the auxiliary member 160 may further protrude toward the one side in the third direction past the substrate 110.

Accordingly, since the auxiliary member 160 can be easily held or pressed, the auxiliary member 160 may be held or pressed to more easily attach or detach the light emitting module 100 to or from the heat sink 200.

According to an embodiment of the present disclosure, in the auxiliary member 160, a first bolt through-hole 162 which passes through the auxiliary member 160 in the third direction and includes a third portion P3 whose cross-sectional area gradually decreases toward the other side in the third direction may be formed. In the heat sink 200, a first bolt insertion groove 202 which communicates with the first bolt through-hole 162 and extends in the third direction may be formed at a position corresponding to the first bolt through-hole 162. A cross-sectional area of the other end of the first bolt through-hole 162 in the third direction may be larger than a cross-sectional area of the first bolt insertion groove 202. A bolt B having a head portion B1 including a shape that corresponds to the third portion P3 may be inserted into the first bolt through-hole 162 and the first bolt insertion groove 202 toward the other side in the third direction.

Accordingly, using the bolt B, the light emitting module 100 can be easily fixed at a correct position. Specifically, since the cross-sectional area of the other end of the first bolt through-hole 162 in the third direction is larger than the cross-sectional area of the first bolt insertion groove 202, when the light emitting module 100 is moved in a state in which the light emitting module 100 is brought into contact with the heat sink 200, the first bolt insertion groove 202 of the heat sink 200 may be easily exposed to the outside through the first bolt through-hole 162 of the auxiliary member 160 of the light emitting module 100. Therefore, the bolt B can be easily inserted into the first bolt insertion groove 202 after passing through the first bolt through-hole 162. Also, since the first bolt through-hole 162 includes the third portion P3 whose cross-sectional area gradually decreases toward the other side in the third direction and the bolt B having the head portion B1 including the shape that corresponds to the third portion P3 (e.g., a flat headed bolt) passes through the first bolt through-hole 162 and is inserted into the first bolt insertion groove 202, when the bolt B is fastened, an inner side surface of the third portion P3 of the auxiliary member 160 may interfere with the head portion B1 of the bolt B, and the light emitting module 100 may move to a correct position.

According to an embodiment of the present disclosure, the light emitting module (100) may further include a heat dissipation plate (170). The other side surface of the substrate (110) in the third direction may be directly coupled to one side in the first direction of one side surface of the heat dissipation plate (170) in the third direction. The auxiliary member (160) may be coupled to the other side of the heat dissipation plate (170) in the first direction. The other side surface of the heat dissipation plate (170) in the third direction may come in contact with the contact surface (S) when the light emitting module terminal (130) is fitted between the connecting portion (320) of the binding clip (300) and the contact surface (S) of the heat sink (200). The auxiliary member (160) may be indirectly coupled to the substrate (110) through the heat dissipation plate (170).

Accordingly, with a low-cost, simple configuration, the auxiliary member 160 which is attached or detached together with the substrate 110 may be easily disposed at the other side of the substrate 110 in the first direction. Thus, the auxiliary member 160 may be held or pressed to easily attach or detach the light emitting module 100 to or from the heat sink 200. Also, since a heat dissipation plate 170 is disposed between the substrate 110 and the heat sink 200, cooling performance may not be reduced even when the substrate 110 does not come in direct contact with the heat sink 200.

Other specific advantageous effects of the present disclosure in addition to the above-mentioned advantageous effects will be described below while describing details for carrying out the disclosure.

The present disclosure has been described above with reference to the accompanying drawings, but the present disclosure is not limited by the embodiments and the drawings disclosed herein, and it is apparent that various modifications may be made to the present disclosure by those of ordinary skill in the art within the scope of the technical spirit of the present disclosure. Further, even when effects according to a certain configuration of the present disclosure are not explicitly described herein, of course, predictable effects of the corresponding configuration should also be acknowledged.

| [Description of Reference Numerals] | |
|---|---|
| 10: Light emitting module replacement type light emitting device | |
| 100: Light emitting modules | 110: Substrate |
| 120: Light emitting diode | 130: Light emitting module terminal |
| 132: First light emitting module terminal | |
| 134: Second light emitting module terminal | |
| 140: Frame | 142: Guide groove |
| 150: Protective glass | 160: Auxiliary member |
| 162: First bolt through-hole | 170: Heat dissipation plate |
| 200: Heat sink | 202: First bolt insertion groove |
| 204: Second bolt insertion grooves | |
| S: Contact surface | |
| 300: Binding clip | 300A: First clip portion |
| 300B: Second clip portion | 310: Coupling portion |
| 320: Connecting portion | |
| 400: Support member | |
| 500: Housing | |

What is claimed is:

1. A light emitting module replacement type light emitting device which extends in a first, a second, and a third directions which intersect each other, comprising:

one or more light emitting modules configured to include a substrate extending in the first direction and the second direction, one or more light emitting diodes mounted on one surface of the substrate in one side of the third direction, and a light emitting module terminal provided on an end of the substrate in one side of the first direction and electrically connected to the one or more light emitting diodes;

a heat sink having a contact surface, which is configured to come in contact with the light emitting modules, provided on a surface of the heat sink in the one side of the third direction; and one or more binding clips, which are configured to include a coupling portion coupled to the heat sink and a connecting portion connected to the coupling portion and positioned on or above the contact surface, and which are electrically connected to an external power supply, wherein the light emitting module terminal of each of the light emitting modules is fitted between the connecting portion of each of the binding clips and the contact surface of the heat sink in the third direction, and accordingly, the light emitting module terminal comes in contact with and is electrically connected to the binding clip, and a surface of the light emitting module in the other side of the third direction comes in contact with the contact surface.

2. The light emitting module replacement type light emitting device of claim 1, wherein:

in the light emitting module replacement type light emitting device, the binding clip and the light emitting module are provided as a plurality of binding clips and a plurality of light emitting modules;

the plurality of binding clips are disposed side by side in the second direction;

the connecting portion of each of the binding clips extends in the first direction or extends in a direction inclined in the third direction toward the first direction; and the light emitting module terminal of each of the light emitting modules is fitted or removed in the first direction between the connecting portion of each of the binding clips and the contact surface of the heat sink in the third direction.

3. The light emitting module replacement type light emitting device of claim 1, wherein:

in each of the light emitting modules, the light emitting module terminal includes a first light emitting module terminal and a second light emitting module terminal provided on both side ends in the second direction respectively at the end of the substrate in the one side of the first direction;

each of the binding clips includes a first clip portion and a second clip portion;

the first clip portion and the second clip portion are disposed a predetermined distance apart from each other in the second direction and each include the coupling portion and the connecting portion; and the first light emitting module terminal comes in contact with and is electrically connected to the first clip portion, and the second light emitting module terminal comes in contact with and is electrically connected to the second clip portion.

4. The light emitting module replacement type light emitting device of claim 1, wherein the binding clip is a leaf spring having elasticity.

5. The light emitting module replacement type light emitting device of claim 1, wherein:

the coupling portion is disposed on or above a surface of the heat sink in the one side of the first direction and is coupled to the surface of the heat sink in the one side of the first direction; and the connecting portion is bent from an end of the coupling portion in the one side of the third direction and extends toward the other side of the first direction or extends in a direction inclined in the third direction toward the other side of the first direction.

6. The light emitting module replacement type light emitting device of claim 5, wherein:

the light emitting module replacement type light emitting device further includes a support member which is coupled to face the surface of the heat sink in the one side of the first direction, extends in the third direction, and protrudes toward the one side of the third direction past the contact surface;

the coupling portion is coupled to a surface of the support member in the one side of the first direction and extends in the third direction along the support member while in contact with the support member to protrude toward the one side of the third direction past the contact surface; and the connecting portion is bent from the end of the coupling portion in the one side of the third direction to extend toward the other side of the first direction or extend in the direction inclined in the third direction toward the other side of the first direction and includes a first portion which extends at a slant at the other side of the third direction toward the other side of the first direction.

7. The light emitting module replacement type light emitting device of claim 1, wherein:

the connecting portion includes the first portion whose distance from the contact surface in the third direction gradually decreases toward a distal end and a second portion disposed at a distal side of the connecting portion past the first portion and whose distance from the contact surface in the third direction gradually increases toward a distal end; and the light emitting module terminal is inserted into a space between the second portion and the contact surface of the heat sink to be fitted between the connecting portion and the contact surface and come in contact with the distal end of the first portion or a rear end of the second portion.

8. The light emitting module replacement type light emitting device of claim 1, wherein the light emitting module further includes a frame coupled to the substrate and configured to surround the one or more light emitting diodes and protrude from the substrate toward the one side of the third direction and a protective glass coupled to the frame and configured to cover the one or more light emitting diodes.

9. The light emitting module replacement type light emitting device of claim 8, wherein:

a guide groove which extends in the second direction and into which the protective glass is inserted is formed in the frame; and the protective glass is inserted into the guide groove in the second direction.

10. The light emitting module replacement type light emitting device of claim 1, wherein the light emitting module terminal is formed of a copper foil formed on the substrate.

11. The light emitting module replacement type light emitting device of claim 1, wherein the light emitting module further includes an auxiliary member disposed at the other end of the substrate in the other side of the first direction and directly coupled or indirectly coupled to the substrate.

12. The light emitting module replacement type light emitting device of claim 11, wherein the auxiliary member further protrudes toward the one side of the third direction past the substrate.

13. The light emitting module replacement type light emitting device of claim 11, wherein:

in the auxiliary member, a first bolt through-hole which passes through the auxiliary member in the third direction and includes a third portion whose cross-sectional area gradually decreases toward the other side of the third direction is formed;

in the heat sink, a first bolt insertion groove which communicates with the first bolt through-hole and extends in the third direction is formed at a position corresponding to the first bolt through-hole;

a cross-sectional area of an end of the first bolt through-hole in the other side of the third direction is larger than a cross-sectional area of the first bolt insertion groove; and a bolt having a head portion including a shape that corresponds to the third portion is inserted into the first bolt through-hole and the first bolt insertion groove toward the other side of the third direction.

14. The light emitting module replacement type light emitting device of claim 11, wherein:

in each of the light emitting modules, the light emitting module terminal includes a first light emitting module terminal and a second light emitting module terminal each provided on both side ends in the second direction respectively at the end of the substrate in the one side of the first direction;

each of the binding clips includes a first clip portion and a second clip portion;

the first clip portion and the second clip portion are disposed a predetermined distance apart from each other in the second direction and each include the coupling portion and the connecting portion;

the first light emitting module terminal comes in contact with and is electrically connected to the first clip portion, and the second light emitting module terminal comes in contact with and is electrically connected to the second clip portion;

in the auxiliary member, a first bolt through-hole which passes through the auxiliary member in the third direction is formed;

a position of the first bolt through-hole in the second direction corresponds to an intermediate position between the first light emitting module terminal and the second light emitting module terminal;

in the heat sink, a first bolt insertion groove which communicates with the first bolt through-hole and extends in the third direction is formed at the position corresponding to the first bolt through-hole; and a bolt is inserted into the first bolt through-hole and the first bolt insertion groove toward the other side of the third direction.

15. The light emitting module replacement type light emitting device of claim 11, wherein:

the light emitting module further includes a heat dissipation plate;

the other surface of the substrate in the other side of the third direction is directly coupled to a portion in the one side of the first direction on one surface of the heat dissipation plate in the one side of the third direction;

the auxiliary member is coupled to a portion of the heat dissipation plate in the other side of the first direction;

the other surface of the heat dissipation plate in the other side of the third direction comes in contact with the contact surface when the light emitting module terminal is fitted between the connecting portion of the binding clip and the contact surface of the heat sink; and the auxiliary member is indirectly coupled to the substrate through the heat dissipation plate.

* * * * *